US009226078B2

(12) United States Patent
Hedges et al.

(10) Patent No.: US 9,226,078 B2
(45) Date of Patent: Dec. 29, 2015

(54) ACOUSTIC TRANSDUCERS

(71) Applicant: Emo Labs, Inc., Waltham, MA (US)

(72) Inventors: Daniel Hedges, Stow, MA (US); Stefan Bokaemper, Newton, MA (US); Terrence Keith Jones, Sharon, MA (US)

(73) Assignee: Emo Labs, Inc., Wellesley, MA (US)

( * ) Notice: Subject to any disclaimer, the term of this patent is extended or adjusted under 35 U.S.C. 154(b) by 0 days.

(21) Appl. No.: 14/212,043

(22) Filed: Mar. 14, 2014

(65) Prior Publication Data

US 2014/0270327 A1 Sep. 18, 2014

Related U.S. Application Data

(60) Provisional application No. 61/791,355, filed on Mar. 15, 2013.

(51) Int. Cl.
*H04R 17/00* (2006.01)
*H04R 7/18* (2006.01)
(Continued)

(52) U.S. Cl.
CPC ..... *H04R 17/00* (2013.01); *H04R 1/00* (2013.01); *H04R 1/22* (2013.01); *H04R 5/00* (2013.01); *H04R 7/045* (2013.01); *H04R 7/12* (2013.01); *H04R 7/16* (2013.01); *H04R 7/18* (2013.01);
(Continued)

(58) Field of Classification Search
CPC ..... H04T 1/00; H04T 1/026; H04T 5/00; H04T 5/02; H04T 7/12; H04T 7/16; H04T 7/18; H04T 17/00; H04T 17/005; H04T 2400/11; H04T 2440/05
USPC ..... 381/152, 162, 163, 191, 423, 426, 431, 381/190, 395, 388, 333; 181/173, 167, 161, 181/154, 166
See application file for complete search history.

(56) References Cited

U.S. PATENT DOCUMENTS

D183,357 S 8/1958 Lindenberg
2,895,062 A 7/1959 Abbott
(Continued)

FOREIGN PATENT DOCUMENTS

CA 2396260 A1 7/2001
CA 2610483 A1 12/2006
(Continued)

OTHER PUBLICATIONS

International Search Report and Written Opinion mailed on Jul. 18, 2014, for International Patent Application No. PCT/US14/28345, filed Mar. 14, 2014 (17 pages).
(Continued)

*Primary Examiner* — Curtis Kuntz
*Assistant Examiner* — Joshua Kaufman
(74) *Attorney, Agent, or Firm* — Brown Rudnick LLP

(57) ABSTRACT

Acoustic transducers may, in certain aspects, include a curved diaphragm and an actuator coupled to the curved diaphragm to cause movement of the curved diaphragm. In certain embodiments, the curved diaphragm has at least one free edge. The left and right edges of the curved diaphragm may be associated with auxiliary supports. The acoustic transducer can be a multi-pole loudspeaker wherein a curved diaphragm radiates the sound energy in a modified dipole pattern. The curvature of the radiating surface of the transducer reduces sound cancellation from sound energy reflected by nearby surfaces.

28 Claims, 27 Drawing Sheets

(51) Int. Cl.

| | |
|---|---|
| ***H04R 1/22*** | (2006.01) |
| ***H04R 5/00*** | (2006.01) |
| ***H04R 7/12*** | (2006.01) |
| ***H04R 7/16*** | (2006.01) |
| ***H04R 7/04*** | (2006.01) |
| ***H04R 9/06*** | (2006.01) |
| ***H04R 1/00*** | (2006.01) |
| *H04R 1/02* | (2006.01) |

(52) U.S. Cl.
CPC ..... *H04R 9/066* (2013.01); *H04R 17/005* (2013.01); *H04R 1/026* (2013.01); *H04R 2400/11* (2013.01); *H04R 2440/05* (2013.01)

(56) References Cited

U.S. PATENT DOCUMENTS

| | | | |
|---|---|---|---|
| D188,326 | S | 7/1960 | Sharp |
| 3,057,961 | A | 10/1962 | ****Turner |
| 3,093,710 | A | 6/1963 | Ten Eyck |
| 3,509,387 | A | 4/1970 | Davies et al. |
| 3,544,201 | A | 12/1970 | Fowler et al. |
| 4,047,060 | A | 9/1977 | Schafft |
| 4,056,742 | A | 11/1977 | Tibbetts |
| 4,088,915 | A | 5/1978 | Kodama |
| 4,140,203 | A | 2/1979 | Niguchi et al. |
| 4,170,742 | A | 10/1979 | Itagaki et al. |
| 4,181,865 | A | 1/1980 | Kohyama |
| 4,186,323 | A | 1/1980 | Cragg et al. |
| 4,198,550 | A | 4/1980 | Matsuda et al. |
| 4,241,313 | A | 12/1980 | Takehara |
| 4,291,205 | A | 9/1981 | Kamon et al. |
| 4,297,185 | A | 10/1981 | Chevreux et al. |
| 4,315,557 | A | 2/1982 | Nakaya et al. |
| 4,352,961 | A | 10/1982 | Kumada et al. |
| 4,454,386 | A | 6/1984 | Koyano |
| 4,503,564 | A | 3/1985 | Edelman et al. |
| 4,571,553 | A | 2/1986 | Yokoyama |
| 4,573,189 | A | 2/1986 | Hall |
| 4,578,613 | A | 3/1986 | Posthuma de Boer et al. |
| 4,593,160 | A | 6/1986 | Nakamura |
| 4,607,145 | A | 8/1986 | Ravinet et al. |
| 4,618,814 | A | 10/1986 | Kato et al. |
| 4,625,138 | A | 11/1986 | Ballato |
| 4,625,259 | A | 11/1986 | Krechmer et al. |
| 4,638,207 | A | 1/1987 | Radice |
| 4,680,800 | A | 7/1987 | Bank et al. |
| 4,751,419 | A | 6/1988 | Takahata |
| 4,807,294 | A | 2/1989 | Iwata et al. |
| 4,847,904 | A | 7/1989 | McShane |
| 4,864,624 | A | 9/1989 | Tichy |
| 4,899,390 | A | 2/1990 | Takewa et al. |
| 4,969,197 | A | 11/1990 | Takaya |
| 4,979,219 | A | 12/1990 | Lin |
| 4,992,692 | A | 2/1991 | Dias |
| 4,997,058 | A | 3/1991 | Bertagni |
| 5,031,222 | A | 7/1991 | Takaya |
| 5,081,683 | A | 1/1992 | Torgeson |
| 5,115,472 | A | 5/1992 | Park et al. |
| 5,193,119 | A | 3/1993 | Tontini et al. |
| 5,265,165 | A | 11/1993 | Rauch |
| 5,283,835 | A | 2/1994 | Athanas |
| 5,368,917 | A | 11/1994 | Rehfeld et al. |
| 5,388,160 | A | 2/1995 | Hashimoto et al. |
| 5,392,000 | A | 2/1995 | Gillig |
| 5,428,832 | A | 6/1995 | Nohara et al. |
| 5,473,214 | A | 12/1995 | Hildebrand |
| 5,524,058 | A | 6/1996 | Moseley |
| 5,526,421 | A | 6/1996 | Berger et al. |
| 5,575,827 | A | 11/1996 | Piniecki |
| 5,608,282 | A | 3/1997 | Wilber et al. |
| 5,615,270 | A | 3/1997 | Miller et al. |
| 5,638,454 | A | 6/1997 | Jones et al. |
| 5,638,456 | A | 6/1997 | Conley et al. |
| 5,642,332 | A | 6/1997 | Chang et al. |
| 5,652,801 | A | 7/1997 | Paddock |
| 5,676,612 | A | 10/1997 | Schellekens et al. |
| 5,684,689 | A | 11/1997 | Hahn |
| 5,684,884 | A | 11/1997 | Nakaya et al. |
| 5,705,878 | A | 1/1998 | Lewis et al. |
| 5,711,058 | A | 1/1998 | Frey |
| 5,736,808 | A | 4/1998 | Szilagyi et al. |
| 5,751,827 | A | 5/1998 | Takahashi |
| 5,767,612 | A | 6/1998 | Takeuchi et al. |
| 5,773,102 | A | 6/1998 | Rehfeld |
| 5,780,958 | A | 7/1998 | Strugach et al. |
| 5,802,195 | A | 9/1998 | Regan et al. |
| 5,825,902 | A | 10/1998 | Fujishima |
| 5,828,768 | A | 10/1998 | Eatwell et al. |
| 5,856,956 | A | 1/1999 | Toki |
| 5,867,302 | A | 2/1999 | Fleming |
| 5,901,231 | A | 5/1999 | Parrella et al. |
| 5,965,249 | A | 10/1999 | Sutton et al. |
| 5,973,441 | A | 10/1999 | Lo et al. |
| 5,977,688 | A | 11/1999 | Utsunomiya et al. |
| 6,003,766 | A | 12/1999 | Azima et al. |
| 6,023,123 | A | 2/2000 | Petiet |
| 6,028,389 | A | 2/2000 | Bernstein |
| 6,031,926 | A | 2/2000 | Azima et al. |
| 6,058,196 | A | 5/2000 | Heron |
| 6,060,811 | A | 5/2000 | Fox et al. |
| 6,064,746 | A | 5/2000 | Nakamura et al. |
| 6,144,746 | A | 11/2000 | Azima et al. |
| 6,151,402 | A | 11/2000 | Azima et al. |
| 6,181,797 | B1 | 1/2001 | Parrella et al. |
| 6,188,775 | B1 | 2/2001 | Azima et al. |
| 6,195,440 | B1 | 2/2001 | Warnaka et al. |
| 6,198,831 | B1 | 3/2001 | Azima et al. |
| 6,215,881 | B1 | 4/2001 | Azima et al. |
| 6,215,882 | B1 | 4/2001 | Heron |
| 6,215,884 | B1 | 4/2001 | Parrella et al. |
| 6,218,766 | B1 | 4/2001 | Warnaka et al. |
| 6,243,473 | B1 | 6/2001 | Azima et al. |
| 6,247,551 | B1 | 6/2001 | Heron |
| 6,278,790 | B1 | 8/2001 | Davis et al. |
| 6,294,859 | B1 | 9/2001 | Jaenker |
| D449,590 | S | 10/2001 | Lewis |
| 6,427,017 | B1 | 7/2002 | Toki |
| 6,437,485 | B1 | 8/2002 | Johansson |
| 6,472,797 | B1 | 10/2002 | Kishimoto |
| 6,504,286 | B1 | 1/2003 | Porat et al. |
| 6,522,460 | B2 | 2/2003 | Bonnedal et al. |
| 6,522,760 | B2 | 2/2003 | Azima et al. |
| D472,543 | S | 4/2003 | Shintani |
| 6,570,299 | B2 | 5/2003 | Takeshima et al. |
| 6,617,765 | B1 | 9/2003 | Lagier et al. |
| 6,708,797 | B2 | 3/2004 | Long et al. |
| 6,720,708 | B2 * | 4/2004 | Athanas ..... 310/324 |
| 6,720,709 | B2 | 4/2004 | Porat et al. |
| 6,741,710 | B1 | 5/2004 | Takeshima et al. |
| 6,785,393 | B2 | 8/2004 | Lipponen et al. |
| 6,797,396 | B1 | 9/2004 | Liu et al. |
| 6,844,657 | B2 | 1/2005 | Miller et al. |
| 6,845,166 | B2 | 1/2005 | Hara et al. |
| D516,059 | S | 2/2006 | Murphy |
| 7,009,326 | B1 | 3/2006 | Matsuo et al. |
| 7,010,143 | B2 | 3/2006 | Kam |
| 7,015,624 | B1 | 3/2006 | Su et al. |
| 7,020,302 | B2 | 3/2006 | Konishi et al. |
| D520,493 | S | 5/2006 | Amsel |
| 7,038,356 | B2 | 5/2006 | Athanas |
| 7,039,206 | B2 | 5/2006 | Mellow |
| 7,050,600 | B2 | 5/2006 | Saiki et al. |
| 7,120,263 | B2 | 10/2006 | Azima et al. |
| 7,151,837 | B2 | 12/2006 | Bank et al. |
| 7,174,025 | B2 | 2/2007 | Azima et al. |
| 7,194,098 | B2 | 3/2007 | Azima et al. |
| 7,212,648 | B2 * | 5/2007 | Saiki et a ..... 381/423 |
| 7,236,602 | B2 | 6/2007 | Gustavsson |
| 7,274,855 | B2 | 9/2007 | Nevo et al. |
| 7,339,736 | B2 | 3/2008 | Trapani et al. |
| 7,536,211 | B2 | 5/2009 | Saiki et al. |
| 7,565,949 | B2 | 7/2009 | Tojo |
| 7,583,811 | B2 | 9/2009 | Wada |

(56) References Cited

U.S. PATENT DOCUMENTS

| | | | | |
|---|---|---|---|---|
| 7,624,839 | B1 | 12/2009 | Graber | |
| 7,788,808 | B1 | 9/2010 | Ptak | |
| 7,792,319 | B2 | 9/2010 | Kimura et al. | |
| 7,884,529 | B2 * | 2/2011 | Johnson et al. | 310/324 |
| 7,889,601 | B2 | 2/2011 | Goodmote et al. | |
| 7,903,091 | B2 | 3/2011 | Lee et al. | |
| D640,233 | S | 6/2011 | Fathollahi | |
| 8,033,674 | B1 | 10/2011 | Coleman et al. | |
| 8,068,635 | B2 | 11/2011 | Carlson et al. | |
| 8,073,162 | B2 * | 12/2011 | Ando | 381/152 |
| D659,674 | S | 5/2012 | Fathollahi | |
| 8,189,851 | B2 * | 5/2012 | Booth et al. | 381/426 |
| D671,524 | S | 11/2012 | Fathollahi | |
| 8,348,407 | B2 | 1/2013 | Matsufuji et al. | |
| 8,395,371 | B2 | 3/2013 | Govil | |
| D681,008 | S | 4/2013 | Fathollahi | |
| D724,555 | S | 3/2015 | Cha et al. | |
| 2001/0026626 | A1 | 10/2001 | Athanas | |
| 2001/0038701 | A1 | 11/2001 | Corynen | |
| 2001/0052627 | A1 | 12/2001 | Takahashi et al. | |
| 2002/0001392 | A1 | 1/2002 | Isono et al. | |
| 2002/0044668 | A1 | 4/2002 | Azima | |
| 2002/0153194 | A1 | 10/2002 | Pocock et al. | |
| 2003/0147541 | A1 * | 8/2003 | Bachmann et al. | 381/152 |
| 2003/0161479 | A1 * | 8/2003 | Yang et al. | 381/22 |
| 2004/0037441 | A1 | 2/2004 | Konishi et al. | |
| 2004/0189151 | A1 | 9/2004 | Athanas | |
| 2004/0228501 | A1 | 11/2004 | Saiki et al. | |
| 2005/0053257 | A1 * | 3/2005 | Johnson et al. | 381/431 |
| 2005/0069430 | A1 | 3/2005 | Sugahara | |
| 2005/0180592 | A1 | 8/2005 | Miura | |
| 2005/0232435 | A1 | 10/2005 | Stothers et al. | |
| 2005/0288039 | A1 | 12/2005 | Liou | |
| 2006/0066803 | A1 | 3/2006 | Aylward et al. | |
| 2006/0120542 | A1 | 6/2006 | Lee et al. | |
| 2006/0269087 | A1 | 11/2006 | Johnson et al. | |
| 2006/0290236 | A1 | 12/2006 | Ikehashi | |
| 2007/0000720 | A1 | 1/2007 | Noro et al. | |
| 2007/0003100 | A1 | 1/2007 | Liu | |
| 2007/0007859 | A1 | 1/2007 | Weber | |
| 2007/0009208 | A1 | 1/2007 | Guenter et al. | |
| 2007/0058827 | A1 * | 3/2007 | Topliss | 381/190 |
| 2007/0092088 | A1 | 4/2007 | Chang | |
| 2007/0133837 | A1 * | 6/2007 | Suzuki et al. | 381/396 |
| 2007/0165886 | A1 * | 7/2007 | Topliss et al. | 381/152 |
| 2007/0223714 | A1 | 9/2007 | Nishikawa | |
| 2007/0243364 | A1 | 10/2007 | Maekawa et al. | |
| 2007/0260019 | A1 | 11/2007 | Ohme et al. | |
| 2007/0297620 | A1 | 12/2007 | Choy | |
| 2008/0007829 | A1 | 1/2008 | Mizushima et al. | |
| 2008/0138541 | A1 | 6/2008 | Moto et al. | |
| 2008/0138543 | A1 | 6/2008 | Hoshino et al. | |
| 2008/0273720 | A1 * | 11/2008 | Johnson et al. | 381/190 |
| 2009/0136690 | A1 | 5/2009 | Sasada | |
| 2009/0190791 | A1 | 7/2009 | Unruh et al. | |
| 2009/0200896 | A1 | 8/2009 | Morris et al. | |
| 2009/0285431 | A1 * | 11/2009 | Carlson et al. | 381/345 |
| 2009/0317592 | A1 | 12/2009 | Yoshitomi et al. | |
| 2010/0224437 | A1 * | 9/2010 | Booth et al. | 181/166 |
| 2010/0284555 | A1 * | 11/2010 | Suzuki et al. | 381/300 |
| 2010/0322455 | A1 | 12/2010 | Carlson | |
| 2011/0026757 | A1 | 2/2011 | Takahashi et al. | |
| 2011/0033074 | A1 | 2/2011 | Chang et al. | |
| 2011/0044476 | A1 | 2/2011 | Burlingame et al. | |
| 2011/0163999 | A1 | 7/2011 | Lin | |
| 2011/0274283 | A1 | 11/2011 | Athanas | |
| 2012/0186903 | A1 * | 7/2012 | Booth et al. | 181/166 |
| 2012/0230524 | A1 | 9/2012 | Chang et al. | |
| 2014/0270279 | A1 | 9/2014 | Jones | |
| 2014/0270327 | A1 * | 9/2014 | Hedges et al. | 381/398 |

FOREIGN PATENT DOCUMENTS

| | | | |
|---|---|---|---|
| CN | 102300141 | A | 12/2011 |
| EP | 1395083 | A2 | 3/2004 |
| FR | 2649575 | A1 | 1/1991 |
| GB | 1369241 | A | 10/1974 |
| JP | 52045923 | | 4/1977 |
| JP | 5615182 | | 7/1979 |
| JP | 57181298 | | 11/1982 |
| JP | 58034699 | | 3/1983 |
| JP | 58182999 | | 10/1983 |
| JP | 63176098 | | 7/1988 |
| JP | 63176099 | | 7/1988 |
| JP | 63250995 | | 10/1988 |
| JP | 64029097 | | 2/1989 |
| JP | 334391 | | 4/1991 |
| JP | 6217296 | | 8/1994 |
| JP | 8102988 | | 4/1996 |
| JP | 9298798 | | 11/1997 |
| JP | 10094093 | | 4/1998 |
| JP | 10327491 | | 12/1998 |
| JP | 11215578 | | 8/1999 |
| JP | 2000350285 | A | 12/2000 |
| JP | 2000356808 | A | 12/2000 |
| JP | 2001500258 | A | 1/2001 |
| JP | 2001503552 | A | 3/2001 |
| JP | 2001320798 | A | 11/2001 |
| JP | 2003529976 | A | 10/2003 |
| JP | 2004147286 | A | 5/2004 |
| JP | 2005105892 | A | 4/2005 |
| JP | 2008514867 | A | 5/2008 |
| JP | 4140999 | B2 | 8/2008 |
| JP | 2010283867 | A | 12/2010 |
| JP | 2012134998 | A | 7/2012 |
| JP | 5122793 | B2 | 1/2013 |
| KR | 2008-0080258 | A | 9/2008 |
| KR | 10-1260543 | | 5/2013 |
| WO | 96/35313 | A1 | 11/1996 |
| WO | 97/09844 | A1 | 3/1997 |
| WO | 97/09846 | A1 | 3/1997 |
| WO | 98/10252 | A2 | 3/1998 |
| WO | 98/28942 | A1 | 7/1998 |
| WO | 01/52400 | A1 | 7/2001 |
| WO | 2004/030406 | A1 | 4/2004 |
| WO | 2006/130731 | A2 | 12/2006 |
| WO | 2006/130782 | A2 | 12/2006 |
| WO | 2009/067669 | A1 | 5/2009 |
| WO | 2009/151892 | A1 | 12/2009 |
| WO | 2012/157691 | A1 | 11/2012 |

OTHER PUBLICATIONS

Backman, 1999, "Improving Piezoelectric Speakers with Feedback," Proc. AES Convention 106, 10 pages.

Beck, 2006, "Hysteresis Characterization Using Charge Feedback Control for a LIPCA Device," Proc. SPIE Int. Soc. For Opt. Eng. 6170, 10 pages.

Furutani, 1998, "Displacement control of piezoelectric element by feedback of induced charge," Nanotechnology 9:93-98.

Decision of Dismissal of Amendment in Japanese Patent Application No. 2007-066645, dated Sep. 27, 2011, 6 pages.

EPO Search Report for European App No. 01901776.3, dated Nov. 2, 2005, 5 pages.

EPO Supplementary Partial Search Report for European App No. 01901776.3, dated Apr. 26, 2005, 6 pages.

EPO Supplementary Search Report for European App No. 01901776.3, dated Aug. 3, 2005, 6 pages.

International Preliminary Examination Report for International Patent App PCT/US01/00349, dated Nov. 22, 2002, 4 pages.

International Preliminary Report on Patentability for International Patent App PCT/US06/21189, dated Dec. 6, 2007, 7 pages.

International Search Report and Written Opinion for International Patent App PCT/US01/00349, dated Apr. 30, 2001, 6 pages.

International Search Report and Written Opinion for International Patent App PCT/US06/21189, dated Nov. 21, 2006, 8 pages.

International Search Report and Written Opinion for International Patent App PCT/US06/21311, dated Sep. 5, 2007, 8 pages.

(56) References Cited

OTHER PUBLICATIONS

International Search Report and Written Opinion for International Patent App PCT/US08/84359, dated Jan. 27, 2009, 6 pages.
International Search Report and Written Opinion for International Patent App PCT/US09/44544, dated Nov. 13, 2009, 7 pages.
International Search Report and Written Opinion for International Patent App PCT/US10/45628, dated Oct. 6, 2010, 10 pages.
International Search Report and Written Opinion for International Patent App PCT/US11/44564, dated Oct. 31, 2011, 9 pages.
International Search Report for International Patent App PCT/GB97/03090, dated Jun. 9, 1998, 5 pages.
Azom.com, A to Z of Materials, Cellulose Acetate—CA, added May 7, 2001, available at http://azom.com/article.aspx?ArticleID=383, retrieved Mar. 16, 2012, 2 pages.
Edmund Optics Worldwide, "TECHSPEC Linear Polarizing Laminated Film," available at http://www.edmundoptics.com/onlinecatalog/displayproduct.cfm?productID-1912, retrieved Dec. 3, 2009, 2 pages.
Harris, 1997, "The distributed-mode loudspeaker (DML) as a broadband acoustic radiator," Audio Engineering Society Preprint 4526 (D-6); Presented at the 103rd Convention Sep. 26-29, 1997 New York, 5 pages.
International Standard, 2006, "Adhesives—Peel test for a flexible-bonded-to-rigid test specimen assembly—Part I: 90 degree peel" ISO Reference No. ISO/FDIS 8510-1:2006 (E), 14 pages.
Kugel, "Bimorph-based piezoelectric air acoustic transducer: model," Sensors and Actuators A: Physical 69(3): 234-42.
PolymerProcessing.com, Poly(ethylene terephthalate), copyrighted 2000, 2001, available at http://www.polymerprocessing.com/polymers/PET.html, retrieved Mar. 16, 2012, 2 pages.
The Engineering Toolbox, Elastic Properties and Young Modulus for some Materials, available at http://www.engineeringtoolbox.com/young-modulus-d_417.html, retrieved Mar. 16, 2012, 4 pages.
The Physics Classroom, "Light Waves and Color—Lesson 1, How do we know light behaves as a wave?" available at http://www.physicsclassroom.com/Class/light/U12L1a.cfm, retrieved Dec. 3, 2009, 2 pages.
International Search Report and Written Opinion mailed on Oct. 1, 2014, for International Patent Application No. PCT/US2014/028113, filed Mar. 14, 2014, (16 pages).
Olson, 1947, Elements of Acoustical Engineering, New York: D. Van Nostrand, pp. 126-132.
Sawada, Electrostatic Research-Functionality. Speaker Design. Feb. 25, 2010.[Retrieved on: Jun. 26, 2014]. Retrieved from internet: <URL:http://1 2pwkkenji.blogspot.com/2010_02_01_archive.html>. entire document.

* cited by examiner

ACOUSTIC TRANSDUCERS

RELATED APPLICATION

This application claims the benefit of and priority to U.S. provisional patent application Ser. No. 61/791,355, filed Mar. 15, 2013, the entirety of which is incorporated by reference herein.

FIELD OF THE INVENTION

The invention generally relates to acoustic transducers.

BACKGROUND

A loudspeaker is a transducer that produces sound in response to an electrical audio signal input. The vast majority of loudspeakers in use today are electromagnetic transducers. Referred to as dynamic loudspeakers, that class has essentially remained unchanged since the 1920's. Typically, a linear motor, such as an electromagnetic or electrostatic motor, actuates a diaphragm, which causes sound waves to be emitted by the speaker.

As a conventional speaker diaphragm is oscillated, it produces sound waves by moving air. The diaphragm produces two, out of phase sound patterns because as it moves forward, pushing air, it is simultaneously pulling air from behind. A speaker that emits sound in that manner is known as a dipole speaker. Dipole speakers create a diffuse, open sound and are typically used as surround speakers in home theater setups for ambient sound effects. Since dipole speakers send out of phase sound in opposite directions to reflect off of various walls and surfaces, they are often considered unsuitable when precise sound localization or image specificity is desired, such as in the accurate reproduction of music. In order to combat the natural dipole action of a speaker diaphragm, conventional speakers must be placed in bulky enclosures to limit and absorb the sound emitted from the back of the diaphragm and create monopole speakers. Those speakers however, lose the wide dispersion characteristics of a dipole speaker, requiring still more bulky speakers and enclosures to distribute sound.

SUMMARY

The invention provides a transducer in which the diaphragm is a frameless curved diaphragm or a diaphragm having a free edge. Unlike traditional, dynamic loudspeakers, transducers of the invention can operate without an enclosure or sealing of the diaphragm to another surface. Stated another way, transducers of the invention can produce high quality sound without interference from a negative pressure wave produced by the transducer even without an enclosure. Without being limited by any particular theory or mechanism of action, it is believed that it is the curve of the diaphragm that makes that possible. Accordingly, transducers of the invention can be made very compact because there is no need for a bulky enclosure, and can be produced with less materials.

In certain embodiments, transducers of the invention do not contain a surround element and are only attached to a support near one edge while at least two edges remain unsupported. Moreover, it also does not contain a protective speaker grille in front or backside of the diaphragm. An advantage of the dipole aspect of the design is the sound dispersion both to the front and to the backside which allows for listening to the transducer from both the front and the back side of the diaphragm while the curve of the diaphragm counteracts the specificity problem found in conventional dipole speakers. An advantage of the frameless design without a speaker grille is that the absence of other mechanical parts eliminates unwanted acoustic reflections, it is cheaper and it allows for a visually unobtrusive appearance, in particular if the diaphragm is transparent or translucent. Such advantageous features allow the diaphragm to be used in optical applications.

An exemplary embodiment of such a transducer includes a curved diaphragm having a free edge. A support is coupled to the diaphragm, and an actuator is coupled to the diaphragm for causing movement of the diaphragm. Numerous configurations for such transducers are possible. An exemplary configuration is one in which the diaphragm has a top portion and a bottom portion and the support and the actuator are associated with the bottom portion of the diaphragm. In such a configuration, the free edge is preferably an edge along a top portion of the diaphragm, although other edges may be the free edge. To provide structural support, it is possible, although not necessary, for each of left and right edges of the diaphragm to be associated with an auxiliary support. In certain embodiments, the transducer includes more than one free edge. Typically, the diaphragm is coupled substantially perpendicularly to the support, although that is not required. The support includes a curve that corresponds to the curve of the diaphragm.

Another embodiment of such a transducer is a multi-pole loudspeaker having a frameless curved diaphragm. In such an embodiment, there is nothing in proximity in front of or in back of a majority of the surface area of the diaphragm. The multi-pole loudspeaker may be a dipole loudspeaker. In an exemplary configuration, the loudspeaker includes a support coupled to the diaphragm. An actuator is coupled to the diaphragm for causing movement of the diaphragm. Typically, the support includes a curve that corresponds to the curve of the diaphragm.

The transducer may be configured such that the diaphragm includes a top portion and a bottom portion and the support and the actuator are coupled to the bottom portion of the diaphragm. Any actuators may be used with transducers of the invention. An exemplary actuator is a piezoelectric actuator. Typically, the actuator is coupled to the diaphragm such that movement of the actuator is transverse to movement of the diaphragm. Since speakers of the invention do not include a frame, the diaphragm may include regions of variable thickness for added support.

In certain aspects of the invention, each of left and right edges of the diaphragm is associated with an auxiliary support. These auxiliary supports provide a more durable mechanical-to-acoustical transducer, designed to better withstand the environment in which they will be used without breaking. The auxiliary supports help to counteract extreme bending forces to the diaphragm from impact to or dropping of the transducer. This can prevent damage to the diaphragm, the actuator and the actuator-diaphragm coupling, where mechanical stress is often concentrated.

DETAILED DESCRIPTION

Figure 1:
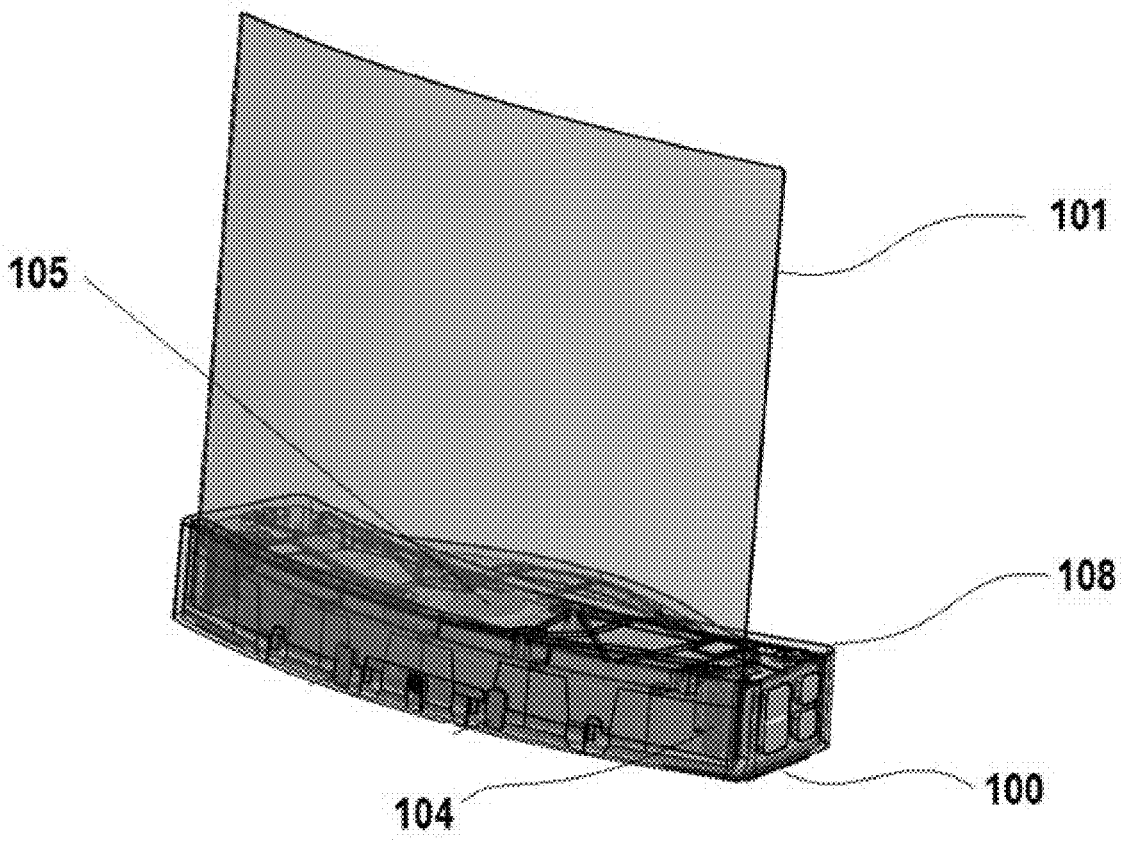
FIG. 1 is a schematic showing a front view of an acoustic transducer of the invention.

The invention generally relates to acoustic transducers. In certain embodiments, the transducers of the invention have bending type piezoelectric actuators where the diaphragm is curved, the piezoelectric actuator is mechanically attached to the diaphragm and where the movement of the mid-point of the diaphragm between actuator and support or between two actuators moving against each other is mechanically amplified relative to the movement of the actuator by virtue of its mechanical construction. Such a transducer is subsequently called a mechanically amplified transducer. FIGS. 1-7 show an exemplary acoustic transducer of the invention. Transducers of the invention may include a support 100. The support may be a base as shown in FIGS. 1-7. Transducers of the invention may receive their audio signal or signals by wired or wireless connection to the signal source. Wireless transducers are described for example in Carlson (U.S. patent application number 2010/0322455), the content of which is incorporated by reference herein in its entirety.

Transducers of the invention may include a diaphragm 101. The diaphragm 101 may be a thin, flexible sheet. The diaphragm may be flat or formed with curvature, for example a parabolic section. In certain embodiments, the diaphragm includes several curvatures. In certain embodiments, when in its resting position the diaphragm is curved in the section between the piezo actuator attachment point and a support (or a second actuator). The diaphragm may be any solid material including such plastics as Kapton (poly amide-imide), polycarbonate, PMMA, PET, PVDF, polypropylene, or related polymer blends; or optical quality materials such as tri-acetates, and tempered glass; or aluminum, titanium or other metals; or carbon fiber composite; or paper; or resin doped fabrics; or foams; or other composites. The diaphragm in certain embodiments is made of a material with no or with only negligible piezoelectricity. The diaphragm may be made to be opaque or optically clear. The diaphragm may include a light polarizing layer or a damping layer, or both. Polarizing and damping layers are described for example in Booth (U.S. patent application number 2012/0186903), the content of which is incorporated by reference herein in its entirety. The diaphragm may also be coated with a light diffusion texture or coating to facilitate the projection of images or light. The diaphragm may be composed of a flexible display component.

In certain embodiments, the diaphragm is curved. The curve can be between 0 and 180 degrees. The convex side of the curved diaphragm forms the front of the transducer and broadcasts sound with a wide dispersion pattern depending on the degree of the curve. The concave side of the curved diaphragm forms the back of the transducer and, without being limited by any particular theory or mechanism of action, it is believed that this curve serves to minimize interference caused by out of phase sound waves or negative pressure reflecting off of surfaces as seen in standard dipole speakers. This characteristic allows for placement of the transducer with the convex side of the diaphragm facing and in close proximity to a wall.

The dipole aspect of the transducer and the lack of enclosure provides for even greater sound dispersion as sound is emitted from both the front and rear of the transducer.

Figure 33:
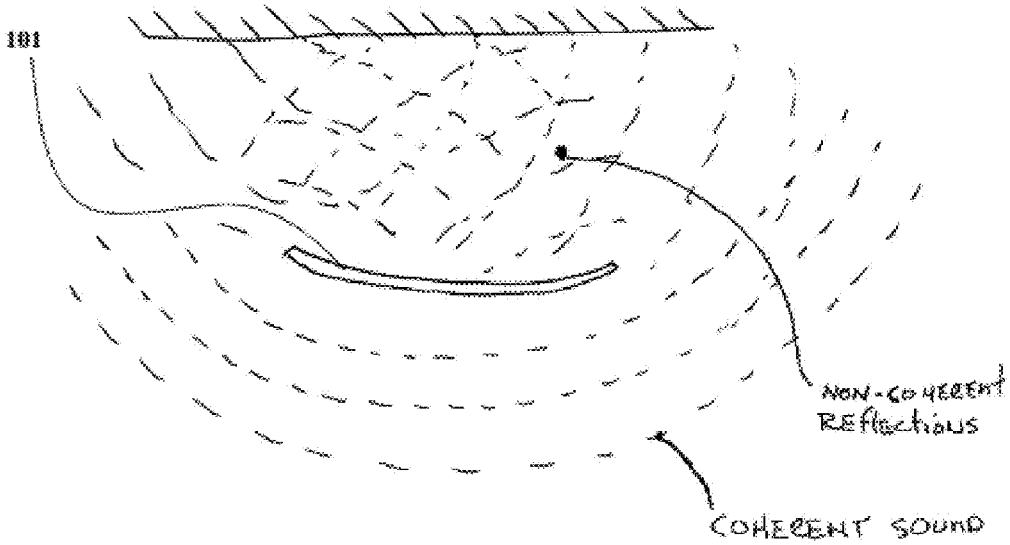
FIG. 33 is a schematic showing the sound dispersion pattern for a transducer of the invention.

In an exemplary embodiment, the diaphragm has a radius of 115 mm and a curve of 50 degrees. An exemplary sound radiation pattern for a transducer of the invention with a curved diaphragm is shown in FIG. 33.

Figure 2:
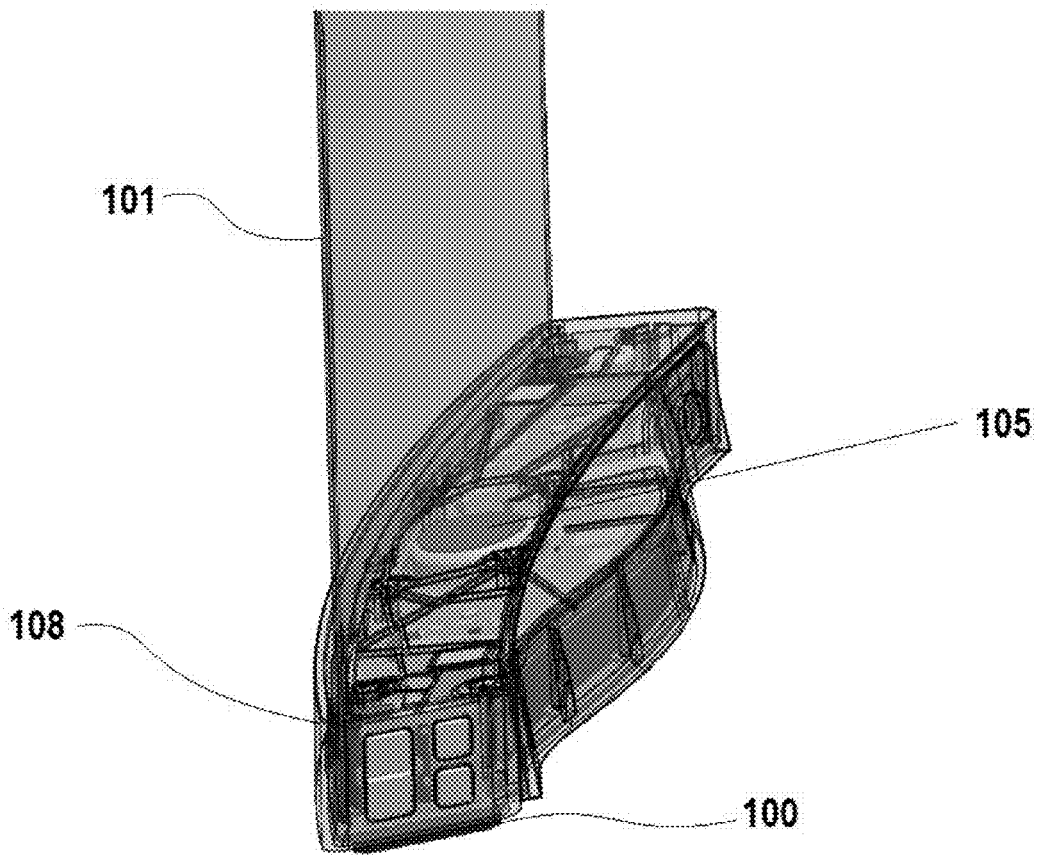
FIG. 2 is a schematic showing a side view of an acoustic transducer of the invention.
Figure 3:
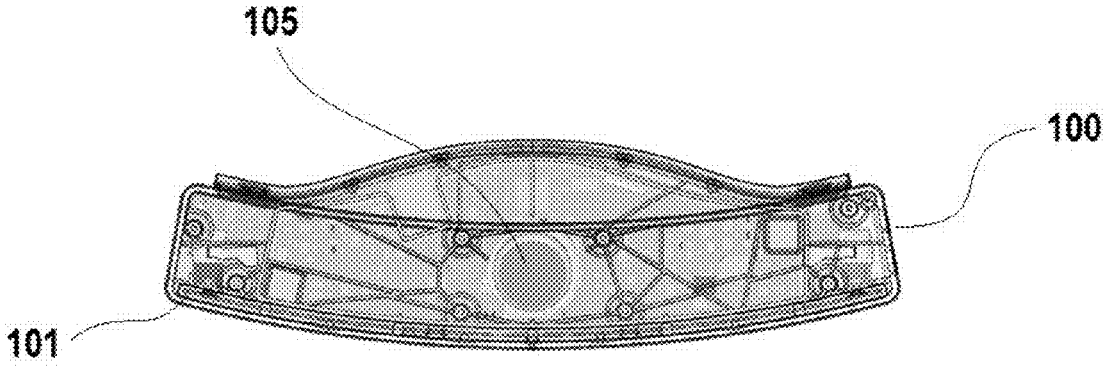
FIG. 3 is a schematic showing a top-down view of an acoustic transducer of the invention.
Figure 4:
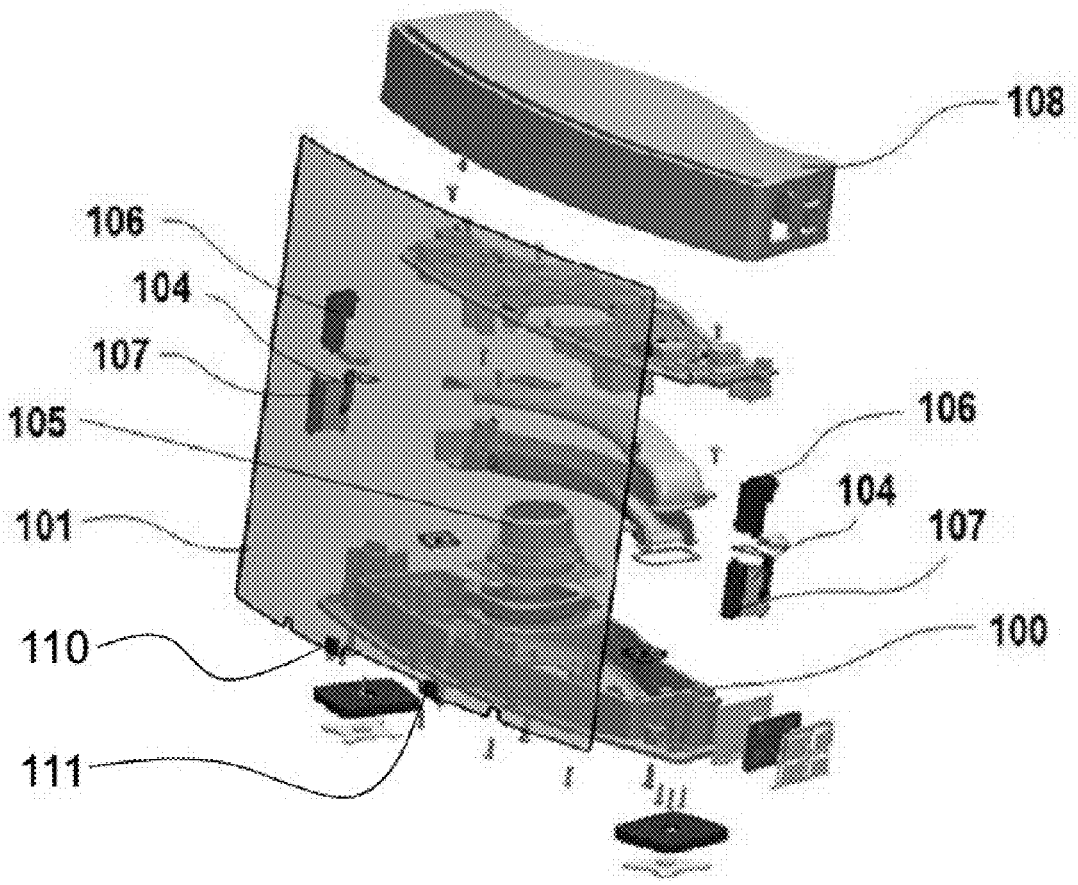
FIG. 4 is a schematic showing an exploded front perspective view of an acoustic transducer of the invention.
Figure 5:
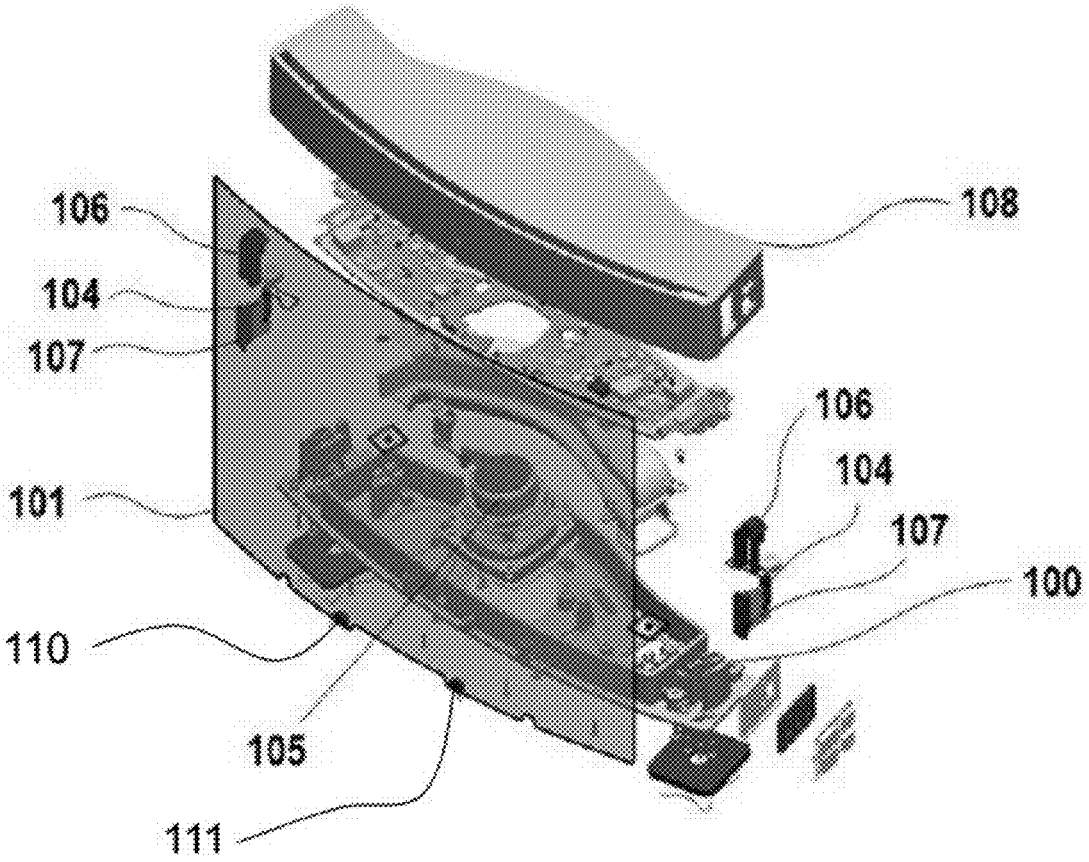
FIG. 5 is a schematic showing an exploded top-down/front perspective view of an acoustic transducer of the invention.
Figure 6:
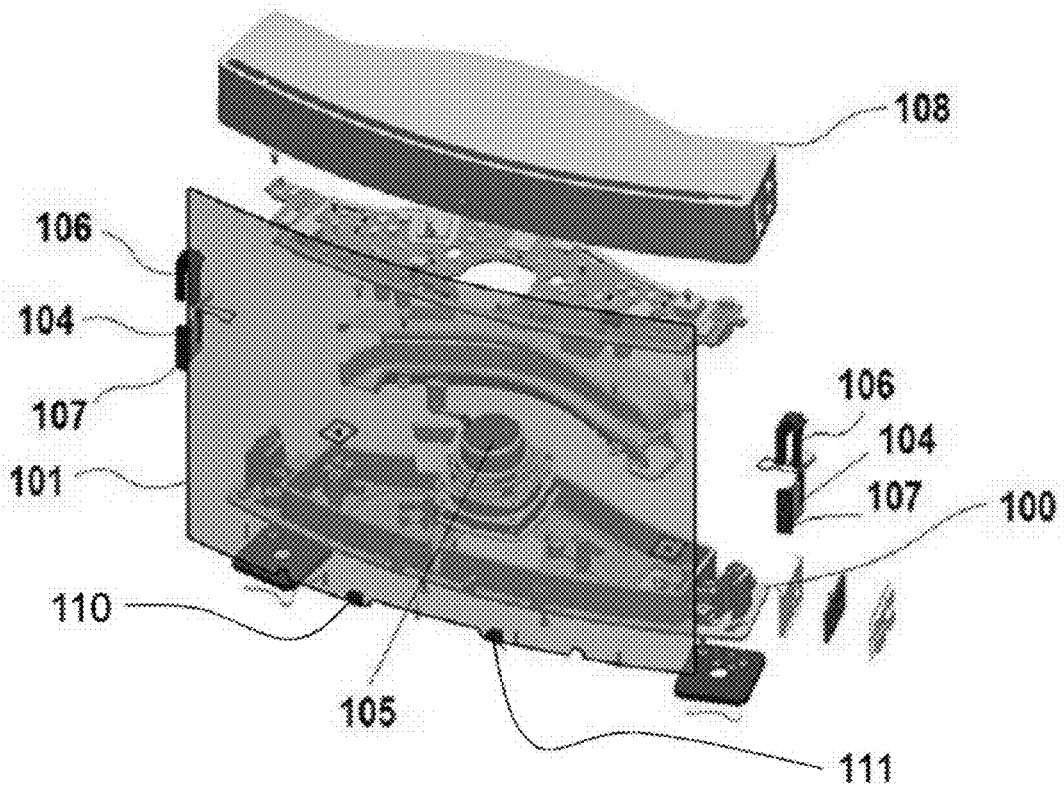
FIG. 6 is a schematic showing an exploded front view of an acoustic transducer of the invention.
Figure 7:
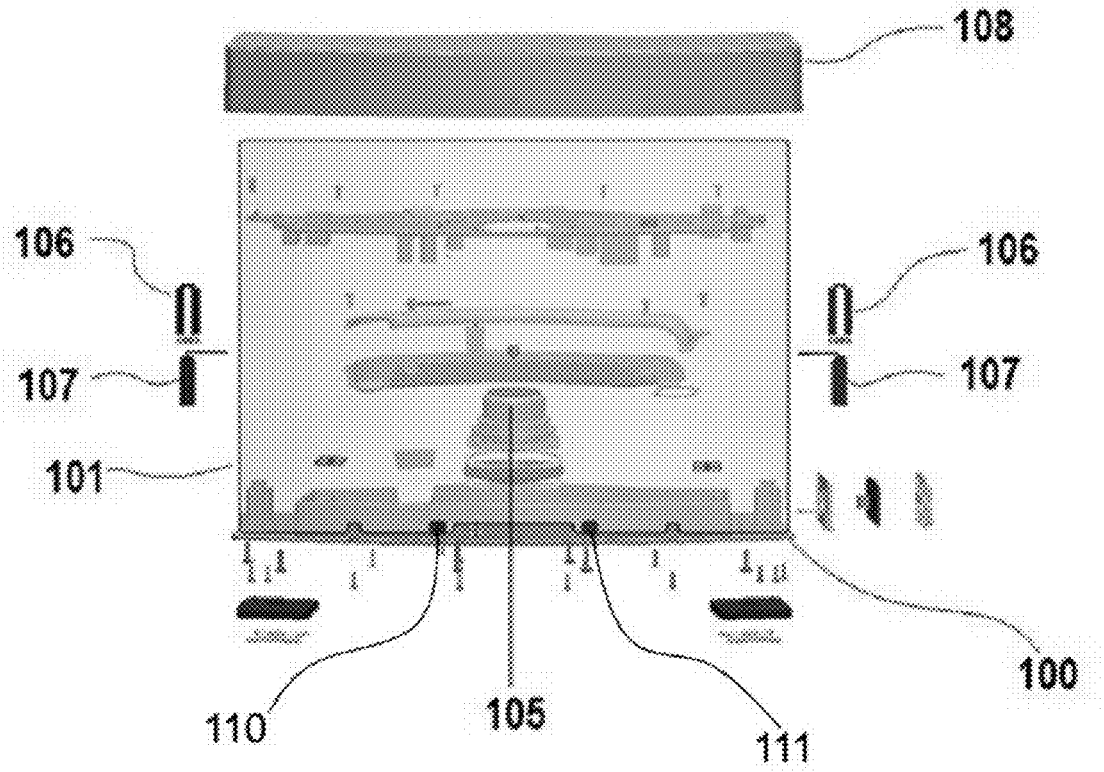
FIG. 7 is a schematic showing an exploded front perspective view of an acoustic transducer of the invention.

The diaphragm 101 couples to the support 100. When the diaphragm 101 is curved, the support 100 may include a curve that matches the curve of the diaphragm. The exemplary coupling in FIGS. 1-3 show a bottom portion of the diaphragm 101 coupling to the support 100. In a particular embodiment, the coupling is so that the diaphragm 101 is substantially perpendicular to the support 100. The coupling may be by any mechanism known in the art, e.g., adhesives, friction, clamp, fasteners, rivets, material connection such as those made by laser welding or ultrasonic welding, or magnetic connection. The diaphragm 101 is coupled to support 100 via at least one contact point. In some embodiments, more than one contact point will be used for the coupling, such as the actuator and a portion of a support. Those contact points are flanges on the front and back of the support 100. The diaphragm 101 fits between the flanges at the contact points and is coupled to the diaphragm. By using two contact points, the diaphragm is effectively split into two regions, thereby allowing the diaphragm to produce sound independently from a first portion of the diaphragm and a second portion of the diaphragm. That concept is further described in Athanas (U.S. Pat. No. 6,720,708), the content of which is incorporated by reference herein in its entirety.

It is important to note that the above description is exemplary and not limiting of the invention. Numerous other coupling configurations are possible and the invention is not limited to any specific coupling configuration. For example, transducers of the invention can be configured so that the coupling points are one actuator and one support, or one actuator and multiple supports, or two or more actuators (opposing each other) and no support at all, as well as two or more actuators and one or more supports.

Transducers of the invention include at least one actuator 104 that is coupled to the diaphragm. In certain embodiments, the actuator is a bending type piezoelectric actuators such as for example unimorph, bimorph, trimorph, or multimorph type benders. In certain embodiments, a single actuator designed transducer has the actuator coupled to a center line of the diaphragm. FIGS. 1-7 show an embodiment that uses two actuators 104. The actuators 104 are shown to be coupled along a bottom portion of the diaphragm on the lower left and lower right sides of the diaphragm 101. This location of the actuators is exemplary and other couplings are within the scope of the invention. In certain embodiments, the actuators 104 are also coupled to the support 100, although this is not required. The coupling is exemplified in FIGS. 8-11. Essentially, the actuator is seated in a hollowed-out section of the base and coupled to the base, by for example, thermal bonding, adhesive, or mechanical clamping. In certain embodiments, the actuator can also sit in a separate holder piece that in turn is attached to the base.

Any type of actuator known in the art may be used with methods of the invention, and an exemplary actuator is a piezoelectric actuator. A piezo bimorph is one type of suitable drive mechanism or actuator for this invention. An example of a Piezo Multimorph is a five layer device consisting of four plates of piezo material with a conductive coating on each side bonded to a central substrate. The substrate provides some spring force. It also can act as a dampener. The piezo plates are available for example from CTS Electronic Components, Inc. Piezoelectric Products 4800 Alameda Blvd NE Albuquerque, N. Mex. 87113. A type that may be used is 3195STD. The piezo plates expand or contract in the X-and Y-axis (a direction generally aligned with vertical axis and lying in the plate). In one configuration the plates are stacked up with alternating poling direction on each side and driven with a signal that is inverted relative from one side to the other. As a result, two plates expand, and the other two plates contract at the same times, which causes the actuator to bend in the z-direction. The final bending motion far exceeds the expansion of a single piezo wafer's movement.

The coupling of the actuators 104 to the diaphragm 101 is such that movement of the actuators causes the diaphragm to move in a direction transverse to the movement of the actuators. Further description of how the actuators cause movement of the diaphragm is described in Athanas (U.S. Pat. Nos. 6,720,708; 7,038,356), Johnson (U.S. Pat. No. 7,884,529), Carlson, et al. (U.S. Pat. No. 8,068,635), and Booth, et al. (U.S. Pat. No. 8,189,851), the content of each of which is incorporated by reference herein in its entirety.

The base 100 may hold the electronics of the acoustic transducer. Electronics for loudspeakers are described for example in Burlingame (U.S. patent application number 2011/0044476), the content of which is incorporated by reference herein in its entirety. The base may also optionally hold a speaker. FIGS. 1-7 show an exemplary base 100 holding a speaker 105. In such an embodiment, the speaker 105 emits acoustic energy at a first range of frequencies. In such an embodiment, the diaphragm 101 emits acoustic energy at a second range of frequencies. The first and second ranges may overlap or even be identical. However, in a preferred embodiment, the first and second ranges have little to no overlap once an electronics crossover is applied to the audio signal. In an exemplary embodiment, the speaker in the base is the primary emitter of acoustic energy at a frequency range of 250 Hz and below, while the diaphragm is the primary emitter of acoustic energy at a frequency range from 250 Hz to 20 kHz.

FIGS. 1-7 exemplify transducers in which the diaphragm 101 has at least one free edge. In FIGS. 1-3, the diaphragm 101 has more than one free edge, i.e., the left and right edges and the top edge are free in space. Only the bottom edge of the diaphragm 101 is restrained in that is coupled to the support 100. In another embodiment the diaphragm is connected to actuators at the bottom edge, to the support at the top edge leaving a free edge at the left and right edge. FIG. 17-21 show several examples of this embodiment. In other embodiments, the bottom edge of the diaphragm 101 is restrained in that is coupled to the support 100, auxiliary vertical supports are used on parts of the left and right edges, leaving only the top edge of the diaphragm free in space.

Furthermore, in FIG. 29-32 there is an attachment point between actuator and diaphragm D and between diaphragm and support S as well as a plane P between the points D and S. The piezoelectric bender moves towards points a or b depending if a positive or negative voltage is applied to the bender. There is a corresponding audio signal amplifier that has a maximum and minimum voltage output. If maximum or minimum voltage is applied at the piezo bender the bender has maximum positive or negative excursion indicated by points a and b. There is also a resting state O. The movement of the attachment point D as voltage is applied follows a curved route. The movement between resting point O and end point A or B can be described by two vectors X and Y with X being parallel to plane P and Y being perpendicular to plane P.

As the diaphragm is mechanically attached to the bender the diaphragm will see a component of its excursion F and G that are perpendicular to plane P. F and G are observed half way along the curvature of the diaphragm between the attachment point of the actuator D and the support S. Typically, the displacement of the diaphragm F is larger than the sum of displacements X and Y. If the piezo bender moves in the opposite direction correspondingly displacement G is larger than the sum of displacements X' and Y'. This type of transducer is mechanically amplified.

By coupling the distal end of a piezo actuator to a curved diaphragm the lateral component of the motion of the distal end of the actuator is converted to a larger perpendicular motion of the diaphragm surface.

Figure 29:
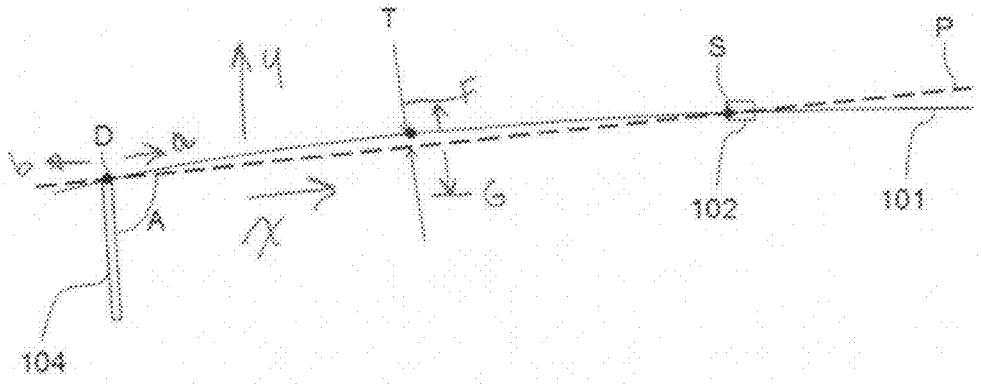
FIG. 29 is a schematic showing an actuator and curved diaphragm with actuator perpendicular to Plane P.

FIG. 29 shows attachment points between the actuator and diaphragm at point D and between the diaphragm and a fixed support at point S. It is noted that the support can be replaced by another actuator that is driven with a signal that makes it move opposite to the movement of actuator 104. Using a reference plane P between the points D and S the tip of the actuator moves point D towards or away from point S depending on whether a positive or negative voltage is applied to the actuator.

Figure 35:
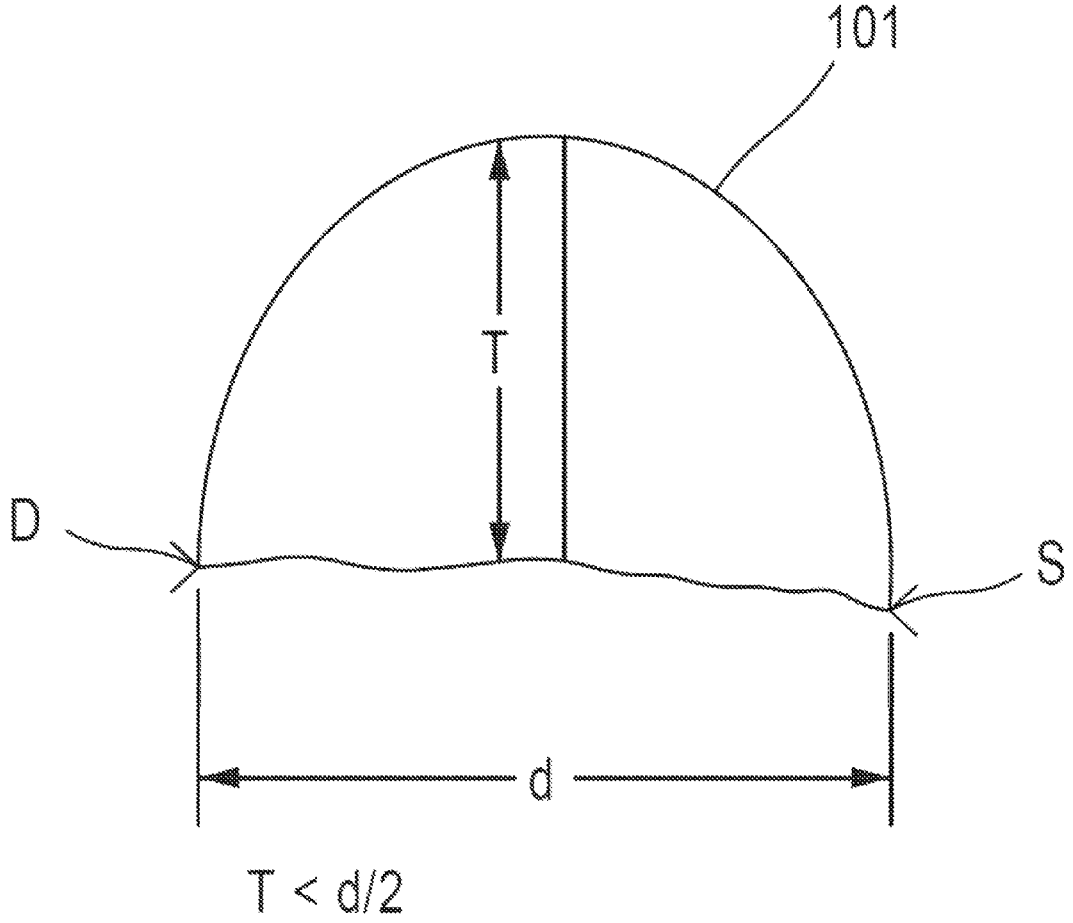
FIG. 35 is a schematic showing chord-length and chord-depth of a curved diaphragm.

The arc-length is the length of the diaphragm segment between points D and S. The chord-length d is the straight line distance between points D and S. The chord-depth T is the maximum perpendicular distance between the diaphragm segment and plane P. This is illustrated in FIG. 35.

The geometry and material properties of the curved diaphragm are chosen such that when the actuator or actuators exert a lateral force on the segment of the diaphragm between D and S the diaphragm will react by flexing and increasing or decreasing its curvature. This can be seen in FIG. 31-32. A change of curvature while maintaining a fixed arc-length results in a changing chord-depth T.

The geometry of the diaphragm is relatively thin and relatively long and its modulus is selected from a group of materials such as plastics, metals, paper, carbon fiber, foam, composites of the before and similar materials.

If such a diaphragm is curved between the attachment point D of the actuator and the support S, it has a substantially fixed arc-length. The lateral motion of the distal end of the actuator results in a change of the chord-length d of the arc. Due to geometric principles when the chord-length d changes and arc-length remains fixed the corresponding chord-depth T will change. In the case that the chord-depth T is less than half of the chord-length d, any incremental changes in the chord-length d will result into a larger incremental change in the chord depth T as long as the diaphragm does not take up a flat shape. We call this effect mechanical amplification. We call the ratio of the incremental change of chord depth T to chord-length d the amplification ratio. As the ratio of chord-length d to chord depth T increases so does the amplification ratio.

The amplification ratio is observed at a frequency significantly below the first mechanical resonance of the transducer and within a range of frequencies between 20 hertz and 20 kilohertz. In a preferred embodiment, the amplification ratio is, for example, at least 1.2, at least 1.5, at least 1.7, at least 2, at least 2.5, at least 3, at least 3.5, at least 4, at least 4.5, at least 5, at least 5.5, at least 6, at least 6.5, at least 7, at least 7.5, at least 8, at least 8.5, at least 9, at least 9.5, at least 10, at least 10.5, at least 11, at least 11.5, at least 12, at least 12.5, at least 13, at least 13.5, at least 14, at least 14.5, at least 15, at least 15.5, at least 16, at least 16.5, at least 17, at least 17.5, at least 18, at least 18.5, at least 19, at least 19.5, or at least 20. In other embodiments, the amplification ratio is any ratio between those recited above.

Figure 30:
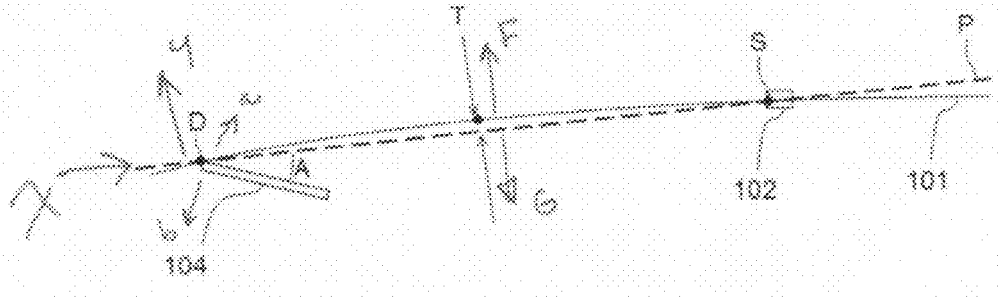
FIG. 30 is a schematic showing actuator and diaphragm with actuator at shallow angle A to Plane P.

In the construction of a speaker transducer the angle A formed between the distal end of the actuator and the plane P can be varied from perpendicular to very shallow angles which result in different proportions of mechanical amplification and motion in different regions of the diaphragm. FIG. 29 shows an example of a transducer with angle A at 90 degrees. FIG. 30 shows an example of a transducer with A close to 0 degrees.

Mechanical amplification occurs for angles A larger than zero degrees and less than 180 degrees. It is noted that actuators can also be attached at the opposite side of the diaphragm at the same point D. Furthermore, mechanical amplification only occurs when the cord-depth T is less than two times the cord-length d.

It is noted that in addition to diaphragm motion due to mechanical amplification the diaphragm will also move with a superimposed displacement equal to the vertical component of the motion of the distal end of the actuator. There is no such superimposed displacement if the angle A is 90 degrees.

At rest position the diaphragm has a neutral shape determined by the relaxed shape of the diaphragm as well as the constraints imposed by the actuator attachment and support. The positive to negative oscillation of the signal voltage to the actuators results in a corresponding positive and negative displacement of the diaphragm relative to the neutral position. This displacement of the diaphragm creates an acoustic air pressure change and allows this design to act as an audio transducer.

Figure 31:
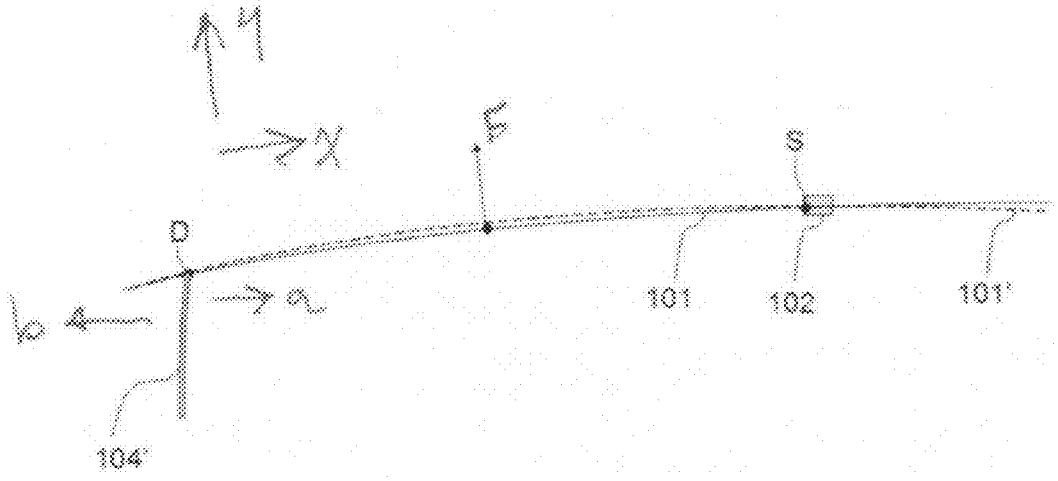
FIG. 31 is a schematic showing a diaphragm in rest position and an actuator and diaphragm in positive shape.

FIG. 31 shows the diaphragm 101 in its rest position as well as the piezo actuator 104' and the diaphragm 101' in its positive shape.

Figure 32:
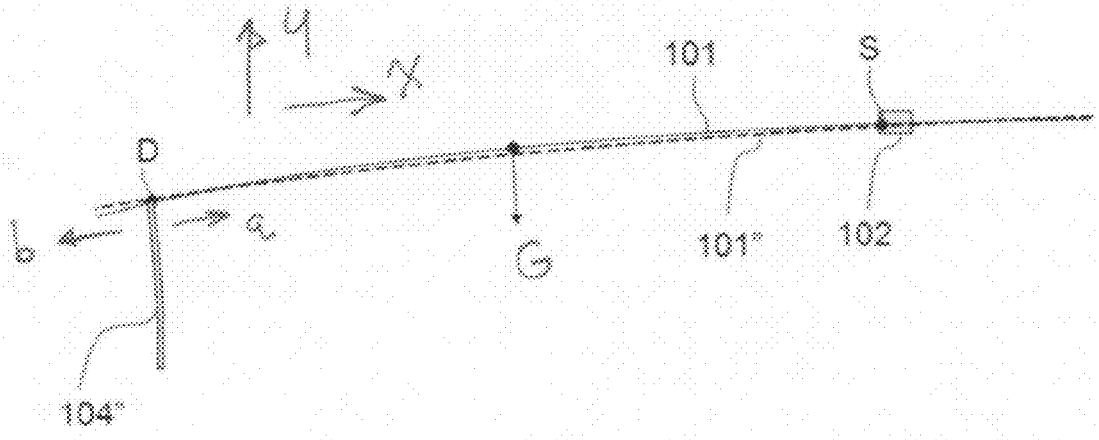
FIG. 32 is a schematic showing a diaphragm in rest position and an actuator and diaphragm in negative shape.

FIG. 32 shows the diaphragm 101 in its rest position as well as the piezo actuator 104" and the diaphragm 101" in its negative shape.

Various combinations of the length of the actuator, baseline chord depth T and chord length d result in different speaker transducer performance in terms of maximum sound pressure level and frequency response.

It is noted that the piezoelectric bender can attach at a wide range of angles relative to the diaphragm. In certain embodiments, transducers of the invention are configured such that movement of the actuator has a component x that is larger than 0 and where the displacement of the diaphragm F is larger than the sum of displacements X and Y. If x were zero than there would be no mechanical amplification of the diaphragm displacement relative to the bender displacement. It is further noted, that the diaphragm can overhang the actuator by any amount. Other variants of the amplified transducer include: actuator or actuators on two opposing sides, no support S; and actuator on two opposing sides, with support S in-between.

In certain embodiments, the transducer is configured such that the piezoelectric effect is limited to the actuator. This means that a piezoelectric actuator, that is separate and distinct from a diaphragm composed of non-piezoelectric material, is used to excite the diaphragm. In case there is any piezoelectric effect in the diaphragm, this is not utilized to actuate the diaphragm. There is no electrical connection between the diaphragm and the audio amplifier.

Acoustic transducers of the invention may optionally include additional features so that the transducer of the invention can better withstand the environment in which they will be used without breaking. For example, piezo actuators are relatively brittle and will get damaged under high dynamic loads and sudden impacts. Additionally, thin diaphragms, as may be used with transducers of the invention, may be fragile due to their relative thinness. If a user drops a transducer onto a floor (for example from 120 cm height) than several reliability problems can occur. For example, the piezo actuator may be damaged or the diaphragm may be damaged.

Reliability problems of this type can often be so severe that the intended use of the transducer is no longer possible. The damage to the piezo actuator typically occurs due to an impact on the transducer in the direction of plane P for example dropping of the product on the floor. The weight of the diaphragm will force the piezo actuator to bend beyond its mechanical breaking limit. A typical example of damage is cracks being created inside the piezoelectric material that cause a dielectric breakdown when voltage is applied and thus preventing the actuator from moving as designed.

A typical damage to the diaphragm is a crack, a hole or a discoloration that typically occur in close proximity to the attachment points between the diaphragm and the actuator or the diaphragm and support. The extent of the damage to the actuator or diaphragm depends on the specific material and design chosen for both. In general the damage will be more severe or will occur more easily the heavier and larger the diaphragm is for a given design. The damage will also be more severe or will occur more easily if the transducer design is of a frameless type. It will also be more severe if the impact is increased for example by increasing the drop height, the weight of the product or the stiffness of the surface the transducer is dropped on.

Particularly for frameless transducers, there is an additional reliability problem as the diaphragm can be bent or torn due to the lack of a frame or speaker grille. As an example, if such a frameless transducer is dropped from 120 cm height onto a hard surface, such as concrete or wood, damage to the piezo actuator or the diaphragm or to both is observed. Moreover, if the transducer is dropped in a plane of the diaphragm on the top side of the diaphragm the diaphragm will bend and create a high stress at the attachment points that leads to cracking of the diaphragm near the attachment point.

Exemplary features that can protect transducers of the invention include: (a) mechanical stop or stops to limit the maximum bending of the actuator; (b) connector piece or pieces with tapered edges; (c) actuator substrate with tapered edges; (d) diaphragm with integrated connector piece with tapered edges; (e) removable and re-attachable diaphragm; (f) mechanical stop to limit bending of diaphragm; (g) member to prevent edge impact onto diaphragm, (h) a relatively soft connector piece between support and diaphragm; and (i) auxiliary supports on the left and right sides, coupled at the top left and right corner. The preferred implementation for each of these measures is described below. The measures can be used individually or in conjunction to improve the reliability of mechanically amplified acoustic transducers with piezoelectric actuators.

The figures show a transducer that includes the additional features a), b), f), g) and h), although transducers of the invention do not need to include all of the features or can include more features at the same time. For example, transducers of the invention can be provided with none of the additional features, with one of the additional features, or with all of the additional features. Stated another way, the additional features described herein are optional, and no embodiment of the invention should be interpreted to require any of the additional features. Also, any combination of the features may be used with transducers of the invention.

(a) Mechanical Stop or Stops

Figure 8:
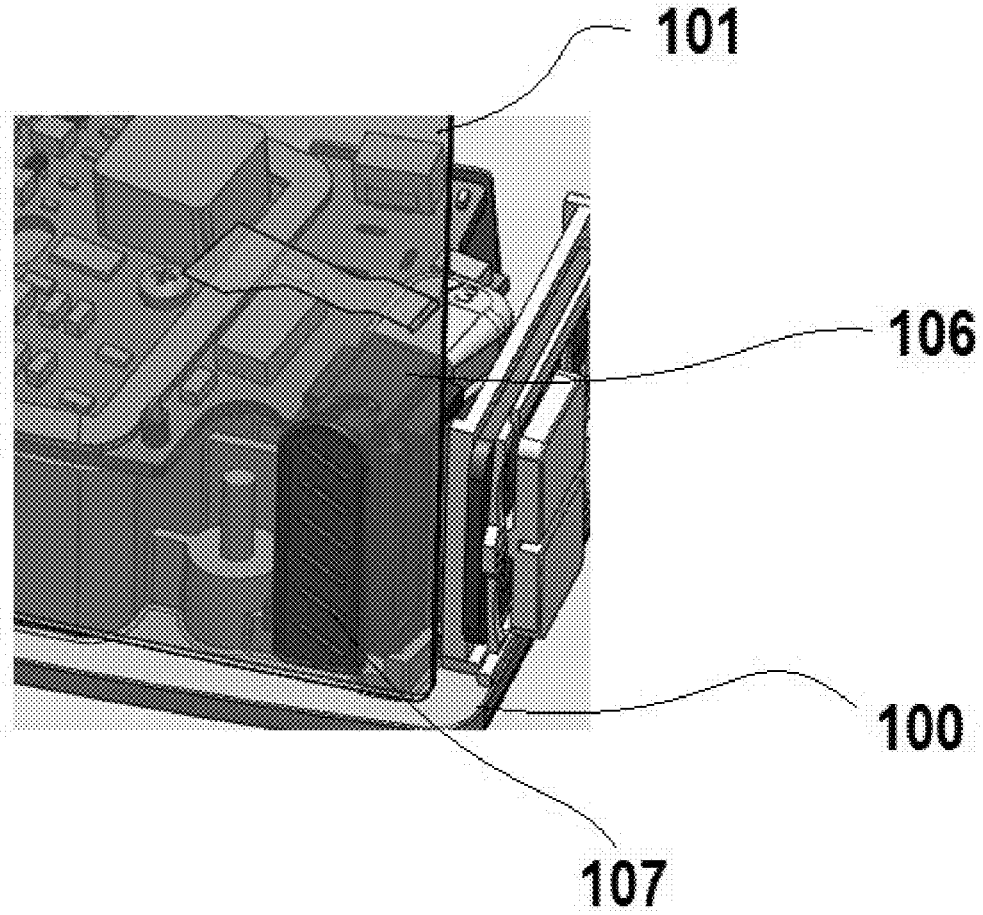
FIG. 8 is a schematic showing front perspective view of a member that limits movement of an actuator.
Figure 9:
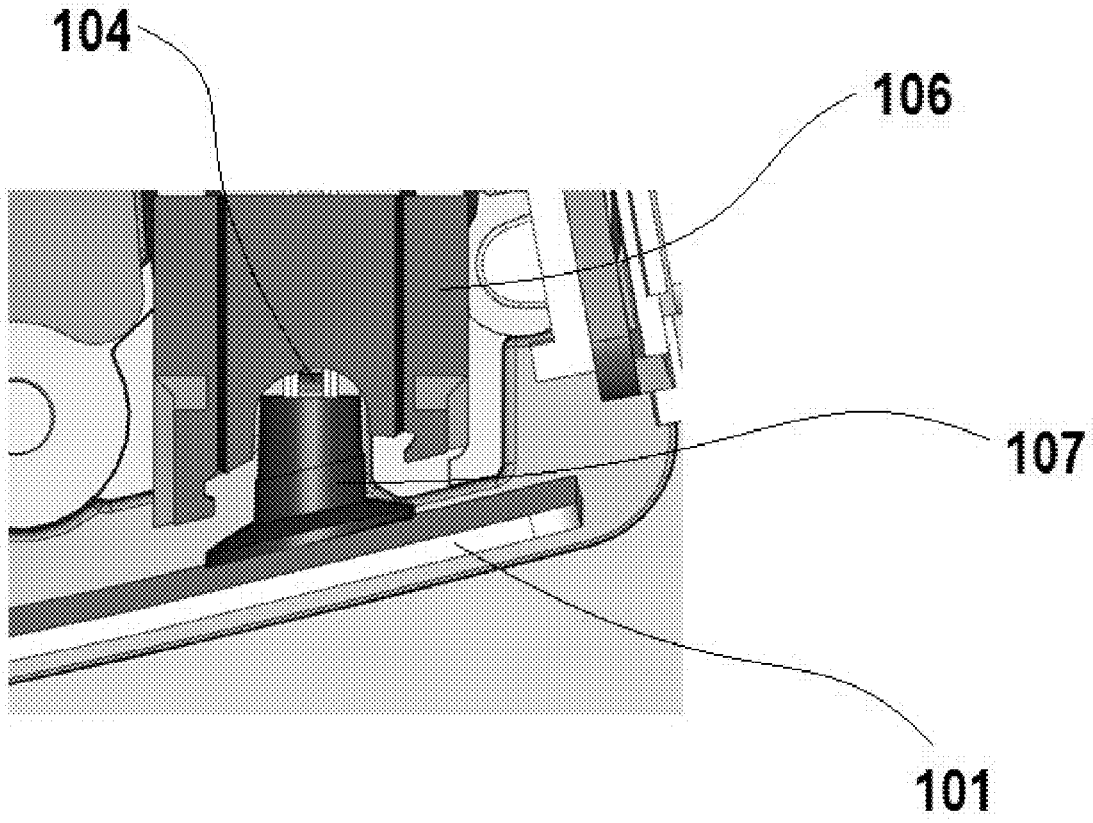
FIG. 9 is a schematic showing top-down view of a member that limits movement of an actuator.
Figure 10:
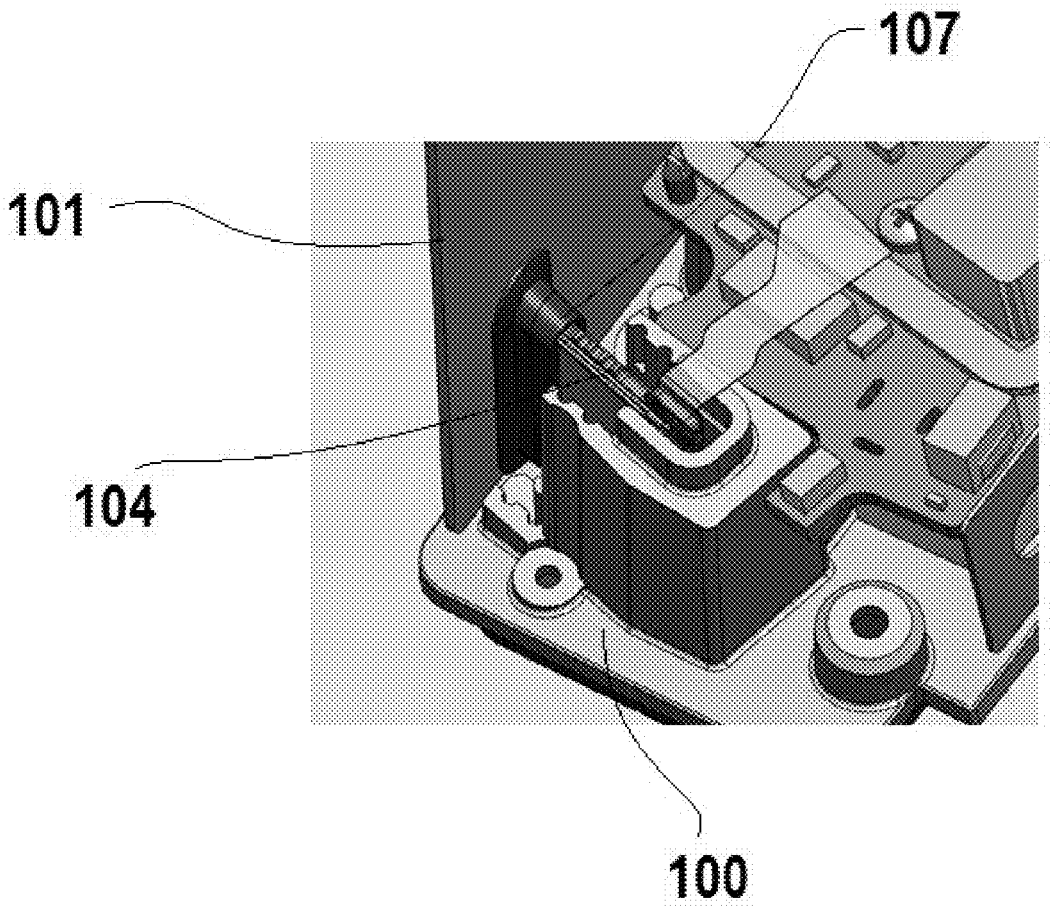
FIG. 10 is a schematic showing a side perspective view of a connector that couples an actuator to a diaphragm.
Figure 11:
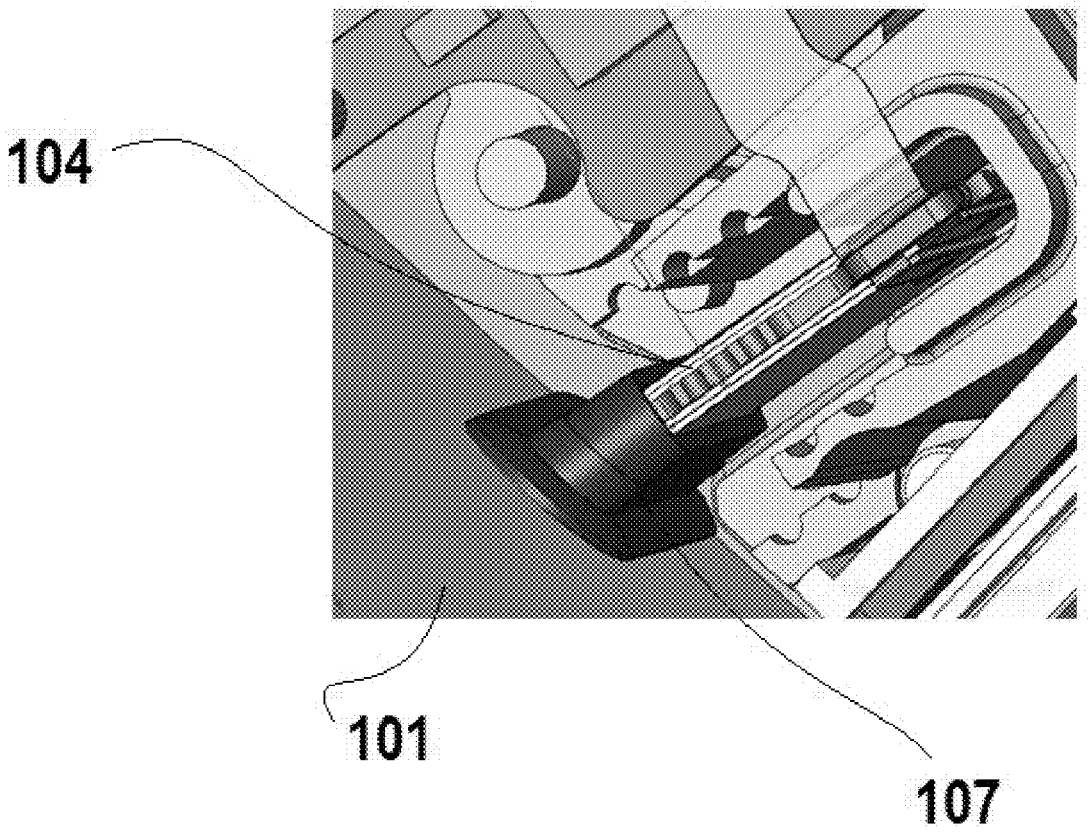
FIG. 11 is a schematic showing a top-down perspective view of a connector that couples an actuator to a diaphragm.

A first feature may be a member that limits bending of the actuator. That member can be seen as 106 in FIGS. 4-7. FIGS. 8-9 show a view of the member 106 fitted over the actuator 104. By limiting bending of the actuator, the ceramic within the actuator is protected from cracking or breaking. This is particularly useful in cases were the speaker is jostled or dropped. Typically, the member is configured so that it does not limit movement of the diaphragm coupled to the actuator when they are within the operating range as an acoustic transducer, as shown in FIGS. 8-9. In certain configures, a distal end of the actuator is coupled to the diaphragm and the member is positioned to interact with a distal portion of the actuator. In other embodiments, the member acts on a coupling piece that connects actuator and diaphragm. In other embodiments, the diaphragm is curved and the member is configured to limit bending of the actuator without interfering with the curved diaphragm when the actuator is used within the standard operating range as an acoustic transducer. The member may be integrally formed with the transducer or may be removably coupled to the transducer. The member exemplified in FIGS. 4-9 is removable from the actuator. In certain embodiments, the actuator includes first and second sides, and the member is configured to interact with only the first or second side. In other embodiments, the actuator includes first and second sides, and the member is configured to interact with both the first and second sides. The safe range depends on the specific construction of the actuator and the transducer and can range from a few hundredths of a mm to several mm on each side of the actuator. An example for a safe range that actuator bending is limited to by the member is 0.15 mm on each side of the actuator for the case of a multi-morph constructed out of 4 piezo plates with 0.3 mm thickness each and one FR4 substrate with 1 mm thickness and with the actuator having a free height of 20 mm. Free height is the distance from the bending tip of the actuator to the point where the actuator is starting to be anchored in the support. The safe range is usually determined experimentally in repeated drop tests as well as bending tests of actuators. The safe range is usually larger than the maximum excursion of the actuator under intended use as a transducer. For the above actuator the internally driven operating deflection of the actuator is a small fraction of the breaking limit (approximately 0.05 mm in each direction).

Figure 14:
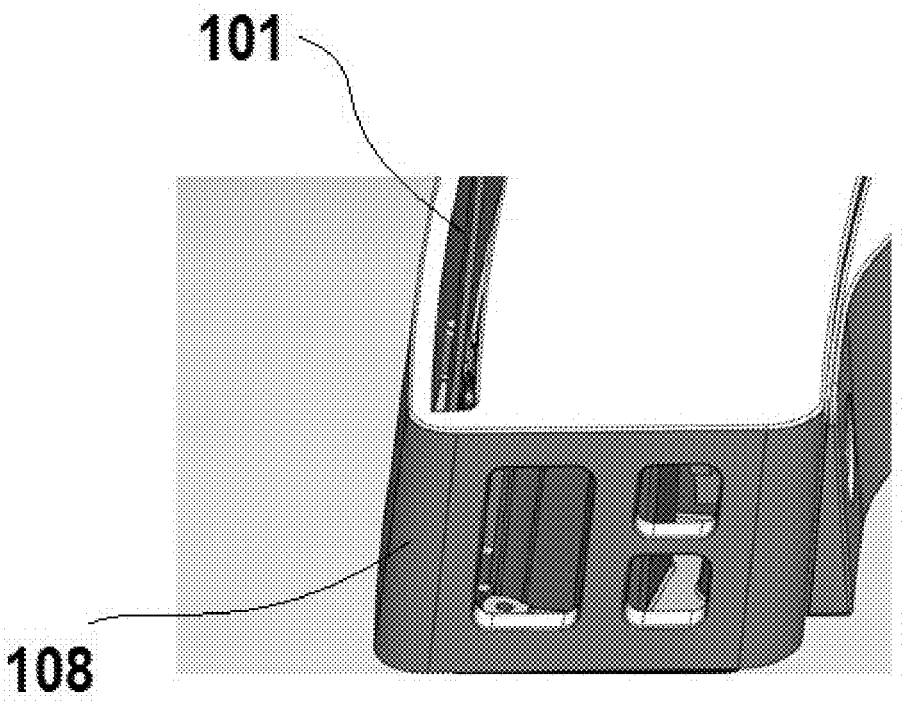
FIG. 14 is a schematic showing a side view of a member that limits movement of a diaphragm.
Figure 15:
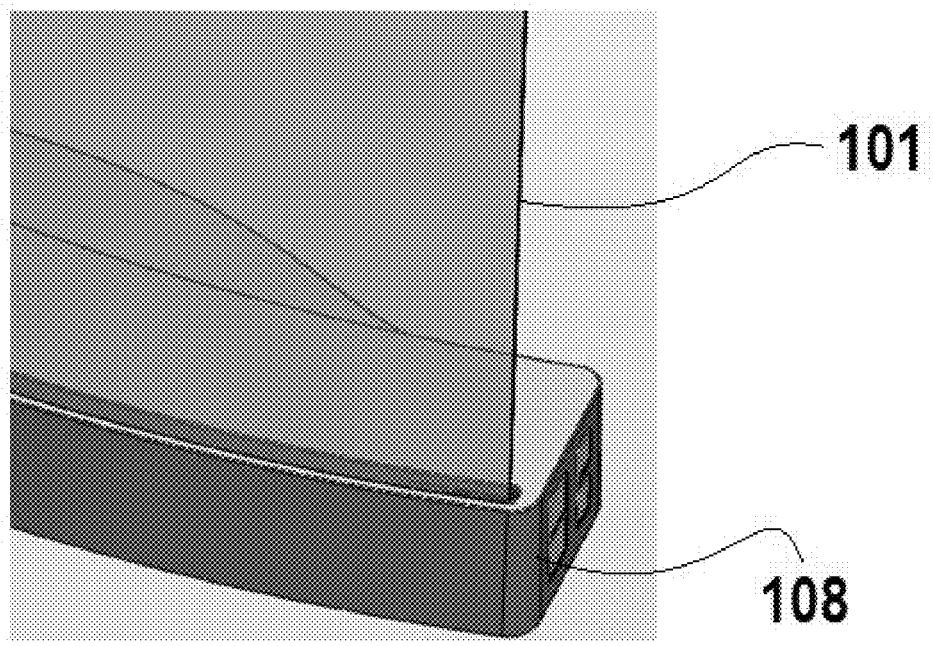
FIG. 15 is a schematic showing a front view of a member that limits movement of a diaphragm.

The member that limits bending of the diaphragm 101 is shown as 108 in FIGS. 1-7 and also in FIGS. 14-15. In certain embodiments, the member 108 is configured so that it limits the diaphragm 101 from bending beyond a certain limit in a direction that is perpendicular to its plane at the point where it attaches to the actuator 103. In this manner, the diaphragm 101 is protected from external forces, such as from dropping, normal contact or other events.

The member may be any component that limits bending of the actuator. The member may be composed of any material, and exemplary materials include plastics, metals and rubbers. A specific exemplary configuration for the member is shown in FIGS. 4-9. That embodiment shows a member that has first and second vertical sides and a top portion that connects the first and second sides. The member may be sized to fit over the actuator. In certain embodiments, the transducer additionally includes a connector 107 that couples the actuator 104 to the diaphragm 101. In those embodiments, the member 106 may limit bending of the actuator through interaction with the connector 107, as shown in FIGS. 8-9.

Figure 12:
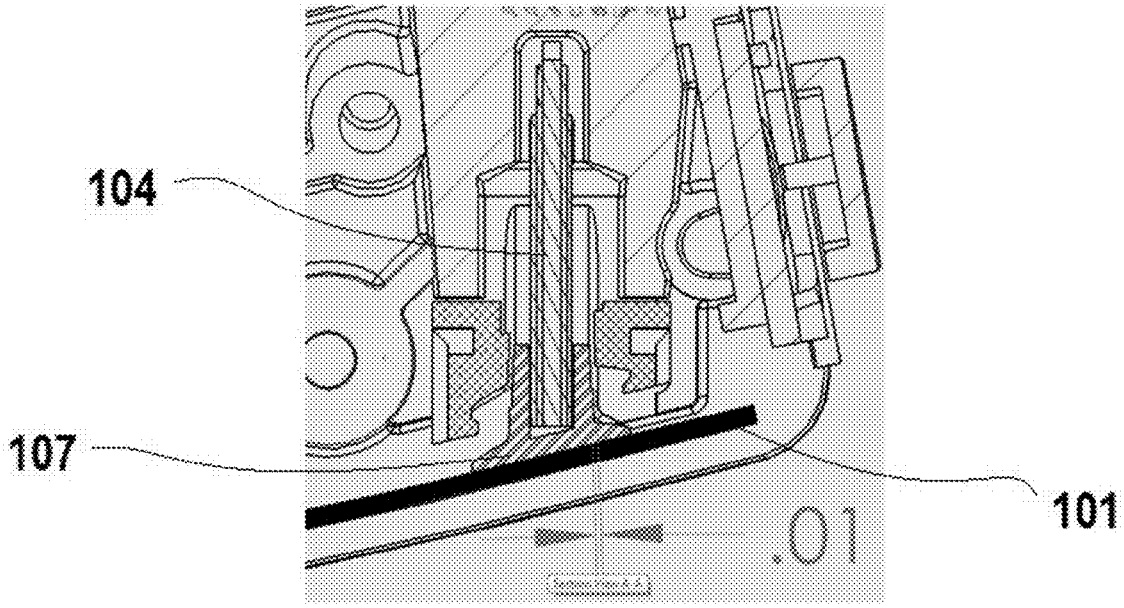
FIG. 12 is a schematic showing a top-down, cutaway view of a connector that couples an actuator to a diaphragm.
Figure 13:
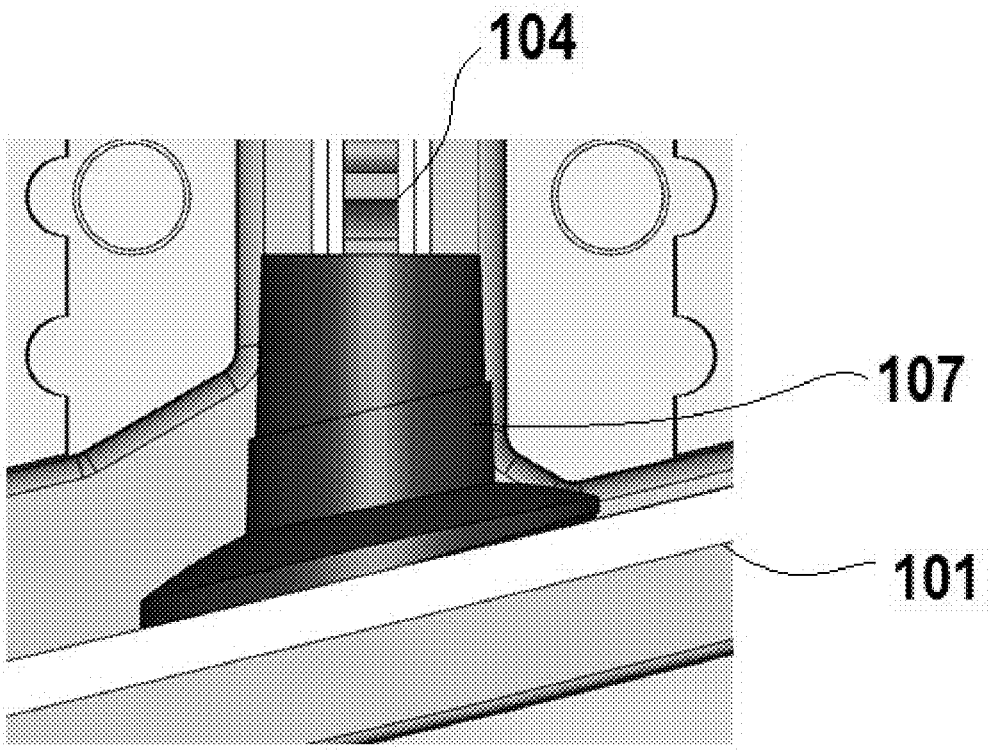
FIG. 13 is a schematic showing a top-down view of a connector that couples an actuator to a diaphragm.

The member may also be an integral feature of the "base/support" instead of a separate part. FIG. 12 shows an exemplary spacing between the connector 107 and an internal part of the base 100, showing that even with the connector 107, the actuator 103 is able to sufficiently move to cause movement of the diaphragm 101. FIG. 13 shows an exemplary embodiment in which the diaphragm 101 is curved. In such an embodiment, the proximal end of the connector 107 is angled to accommodate the curve of the diaphragm 101 while still being able to couple the actuator 104 to the diaphragm 101.

(b) Tapered Connector

Prior art teaches the use of a substrate with a bent over top section against which the diaphragm is attached. The disadvantage of this construction is that a sharp transition corner all around the attachment point or attachment area is formed. This stiffness of the diaphragm changes dramatically at this corner and the corner acts as a stress concentrator. Any sudden impact on the transducer will create a localized very high force at the corner where the diaphragm attaches to the substrate. This high force then causes cracks or holes in the diaphragm or separation of the diaphragm from the substrate or damage to the substrate or a combination of these when dropped for example from a height of 120 cm onto a concrete or wood floor.

In order to overcome this problem a connector with tapered edges is introduced. The connector is shown as 107 in FIGS. 4-7. The connector is also shown in FIGS. 10-13. The connector has a planar proximal end that tapers to a distal end. The proximal end is coupled to the diaphragm 101 and the distal end is coupled to the actuator 104 such that the actuator 104 causes movement of the diaphragm 101. Due to the tapered design of the connector the stiffness of the diaphragm changes gradually when observing it from the unconstrained diaphragm towards the center of the attachment area. This causes the stress loads to be distributed over a larger area and the localized maximum force to be reduced significantly.

Connectors of the invention may have any type of taper. For example, in certain embodiments, the left and right sides of the connector taper from the planar proximal end to the distal end. In other embodiments, the top and bottom sides of the connector taper from the planar proximal end to the distal end. In particular embodiments, all sides of the connector taper from the planar proximal end to the distal end, as is shown in FIGS. 10-13.

Any connecting mechanism may be used to couple the connector to the diaphragm. For example, the connector may be coupled to the diaphragm by adhesives, friction, clamp, fasteners, rivets, material connection such as those made by laser welding or ultrasonic welding, or magnetic connection. The connector also needs to couple to the actuator. An exemplary way to make this connection it to configure the connector such that a portion of the actuator 104 fits within the distal end of the connector 107, as shown in FIGS. 10-13. The connection between connector and actuator can be made for example with an adhesive.

(c) Actuator Substrate with Integrated Connector Piece with Tapered Edges

In some embodiments, the tapered edge or edges as described in (b) above that connect the diaphragm to the actuator are not a separate connector piece but are integrally formed with the substrate element of the actuator. A preferred implementation is a substrate of the actuator that is produced as an injection molded or cast part out of plastic or metallic material and that combines the tapered feature of the connection area with the desired geometry of the actuator substrate.

(d) Diaphragm with Integrated Connector Piece with Tapered Edges

In some embodiments, the connector as described in (b) above is integrally formed with the diaphragm. A distal end of the actuator attaches to the connector as described above, for example by a portion of the actuator fitting within the distal end of the connector. A preferred implementation is a diaphragm made by injection molding, casting or thermoforming that combines the general shape of the connector described above with the desired geometry of the diaphragm into one part.

(e) Removable and Re-Attachable Diaphragm

In certain embodiments, transducer of the invention are designed such that the diaphragm is removable coupled to the actuator. The strength of the connection is designed such that the diaphragm will release from the actuators at a force that is less than an impact force that would damage the diaphragm. In that manner, the diaphragm releases from the actuator prior to a force being applied to the diaphragm that would damage either the diaphragm or the actuators. Any type of releasable connection may be used. In exemplary embodiments, the releasable connection is accomplished using magnets or friction based claims. The strength of the magnets are tuned such that the magnets come loose before a force impact would damage either the diaphragm or the actuator. Other connections may be formed using tapered wedges that create very stiff connections laterally but may be separated easily in a direction parallel to the plane of the actuator.

(f) Mechanical Stop to Limit Bending of Diaphragm

One of the potential ways the diaphragm can get damaged during a drop from for example 120 cm onto a floor is by the transducer dropping onto the diaphragm itself and causing it to bend. This is a particular problem for a transducer with a frameless diaphragm as shown in FIGS. 1-7. If the transducer with a frameless diaphragm is dropped such that the first impact to the floor is made by the diaphragm the diaphragm can be made to bend. In some cases the diaphragm might be bend as much as 180 degrees forcing it momentarily into a U-shape. This bending will cause an extreme stress concentration at the edge of the attachment area between diaphragm and actuator or diaphragm and connector piece. The diaphragm can be constructed to be rugged enough to survive bending of 180 degrees and to spring back into its original shape, however in many implementations the stress concentrator at the attachment area will cause the diaphragm to discolor or to crack. Discoloration is often a precursor of cracking so after application of multiple stresses cracking can be observed. Depending on the design this can even be the case if a design with a tapered edge as described in b), c) and d) above is utilized. To overcome this problem a mechanical stop for the diaphragm is introduced. The mechanical stop is designed such that the diaphragm will be contact the stop before the critical bending radius that causes damage at the attachment point to the actuator or connector is reached. The effect of this stop is that the forces generated by the bending and by the impact are now distributed over two areas: the attachment area of diaphragm and actuator or connector and the contact area of diaphragm and mechanical stop.

The mechanical stop of the invention may have any type of orientation or distance relative to the diaphragm. For example, in certain embodiments, the mechanical stop has the form of a slot and forms a stop on both planar sides of the diaphragm. The position of the diaphragm within the slot may be symmetric or asymmetric relative to the two mechanical stops. In other embodiments, the mechanical stop only interacts with the front or the back side diaphragm in case of a drop with a diaphragm bending of 180 degrees. This can be achieved by having a mechanical stop only on one side of the diaphragm or by having two stops with the one on one side being too far removed to act as a stop.

In particular embodiments, a slot is protecting the diaphragm from bending in both sides at equal distance as is shown in FIG. 15. Any configuration of a member that limits bending of the diaphragm is contemplated by this invention. In certain embodiments, the member surrounds the diaphragm. In other embodiments, the member is located behind the diaphragm. FIGS. 1-7 and FIGS. 14-15 show an exemplary configuration of the member 108 as a housing having a slot. The housing is configured to fit over the diaphragm 101 while the diaphragm extends through the slot. The slot limits movement of the diaphragm. In certain embodiments, the diaphragm is curved and the slot includes a curve that corresponds to the curve of the diaphragm.

(g) Member to Prevent Edge Impact onto Diaphragm

Figure 18:
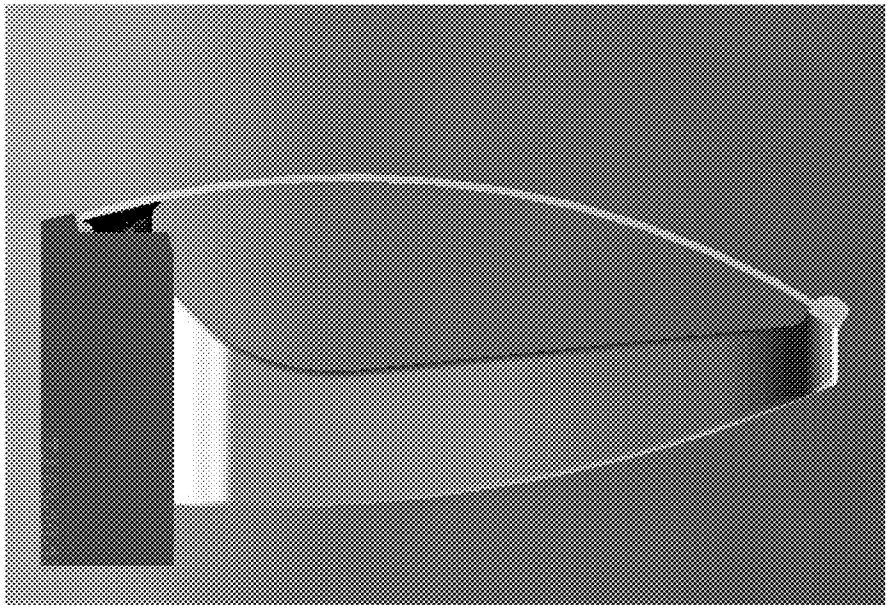
FIG. 18 is a schematic showing a side view of a soundbar of the invention.
Figure 19:
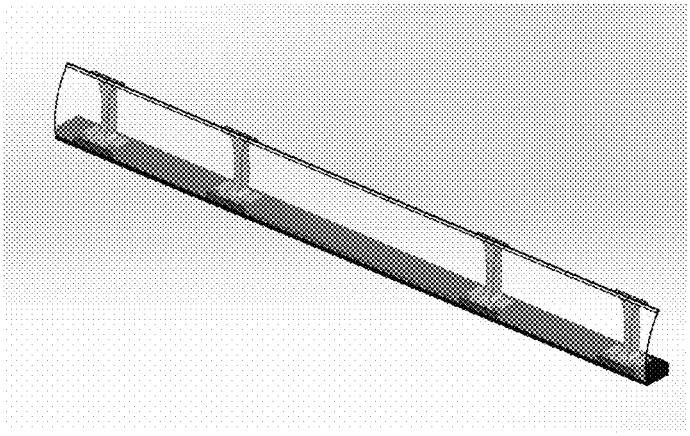
FIG. 19 is a schematic showing a front perspective view of one embodiment of a soundbar of the invention
Figure 20:
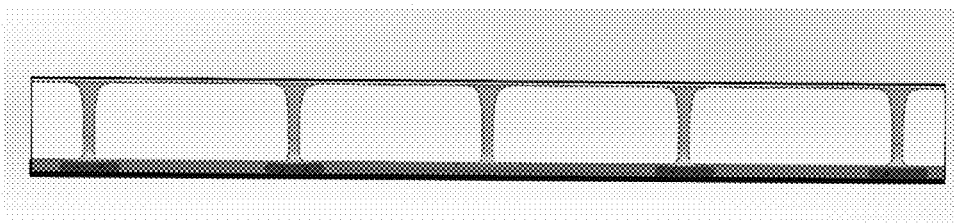
FIG. 20 is a schematic showing a front view of a soundbar of the invention with a center strut.
Figure 21:
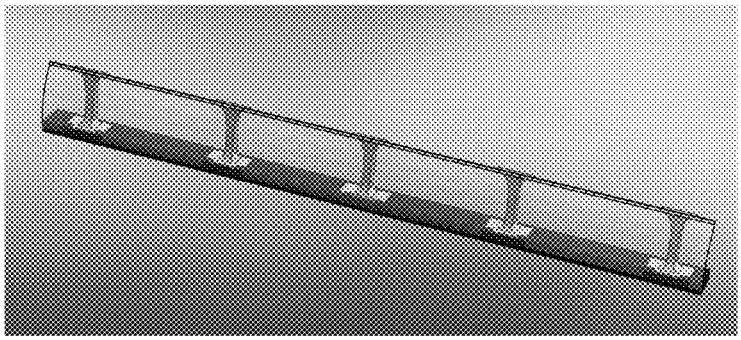
FIG. 21 is a schematic showing a front perspective view of a soundbar of the invention with a center strut.
Figure 22:
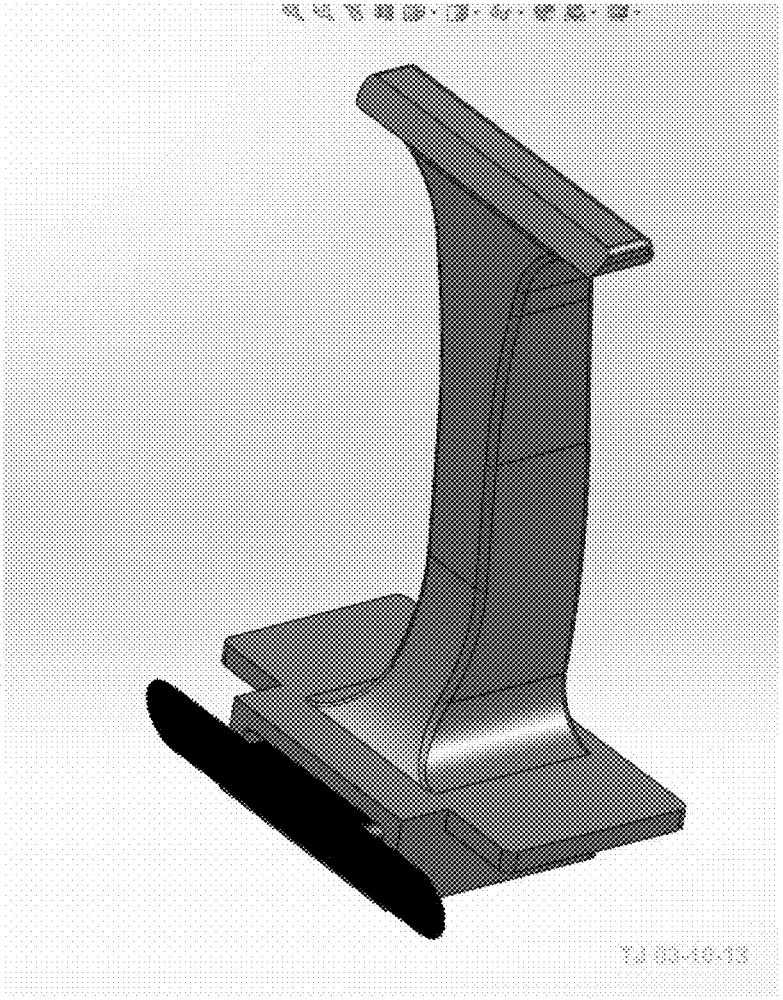
FIG. 22 is a schematic showing a side perspective view of an integrated piezo strut of the invention.
Figure 23:
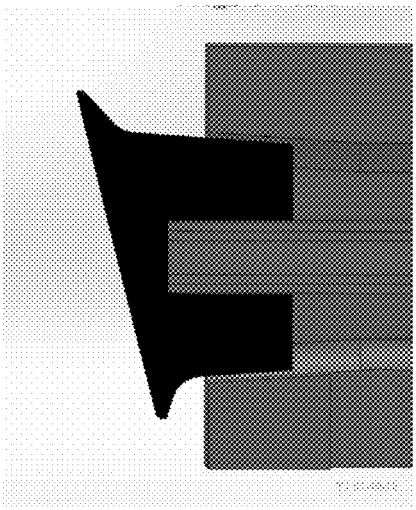
FIG. 23 is a schematic showing a magnified, cutaway, side view of an integrated piezo strut of the invention.
Figure 24:
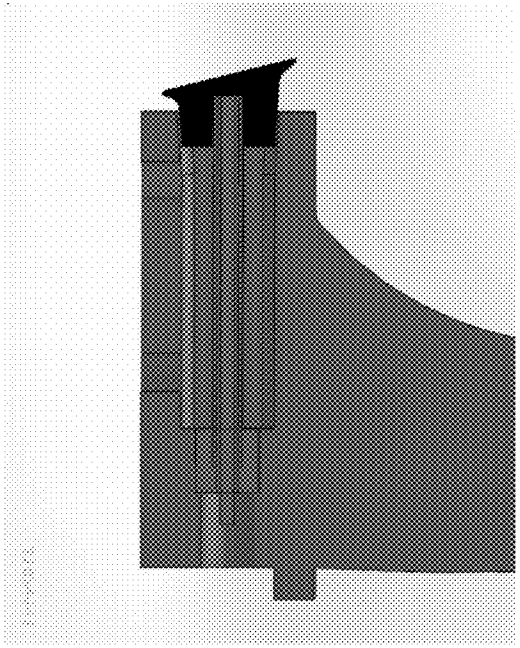
FIG. 24 is a schematic showing a cutaway, side view of an integrated piezo strut of the invention.
Figure 25:
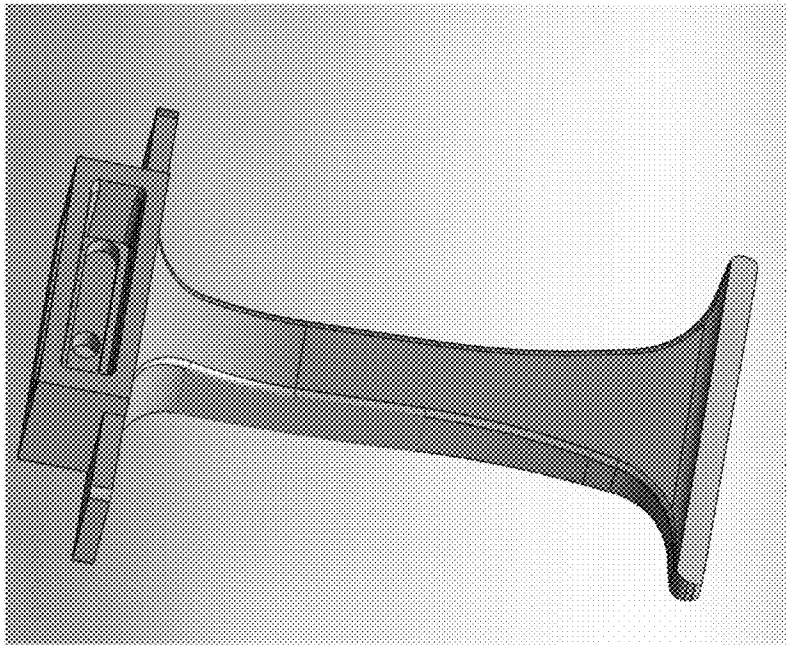
FIG. 25 is a schematic showing front perspective view of an integrated piezo strut of the invention with the strut removed.
Figure 26:
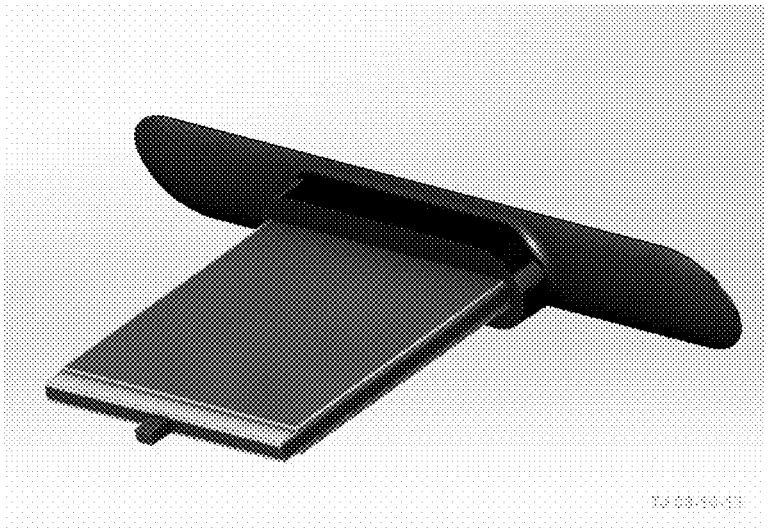
FIG. 26 is a schematic showing a rear perspective view of a piezo strut of the invention.
Figure 27:
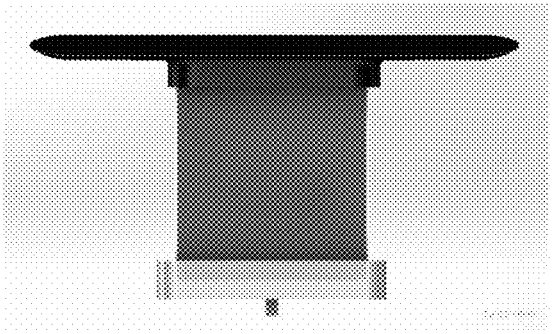
FIG. 27 is a schematic showing a top-down view of a piezo strut of the invention.
Figure 28:
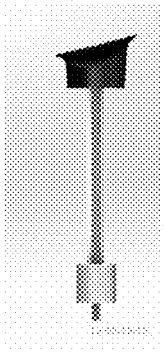
FIG. 28 is a schematic showing a side view of a piezo strut of the invention.

Another durability problem can arise from a direct edge impact onto the diaphragm, in particular in a frameless design. This can create high shear forces onto the interface of diaphragm to actuator or connector that can create damage in the diaphragm or actuator or connector or interface layer. This is a particular problem on the edge or edges of the diaphragm that is attached to the actuator and that is moving as these cannot be protected through firm coupling with a frame. A solution is to introduce a member that physically prevents an edge impact onto one side of the diaphragm. A preferred implementation is shown in FIG. 18 (soundbar). In this implementation the member is part of the base/support and protrudes at least to the height of the diaphragm or beyond and thereby prevents a direct edge impact.

(h) Connector Piece Between Support and Diaphragm

Another area of the diaphragm that can get damaged when dropping the transducer is the connection of the diaphragm to the support. As discussed above a stress concentrator can cause damage to the diaphragm. A solution to this problem is a tapered design of the interconnection point between the diaphragm and the support to achieve a gradual stiffness change. This can be achieved with a tapered connector piece, with a tapered edge that is integral to the diaphragm or with a support that includes a tapered feature. Another solution is the use of a relatively soft and compressible connector piece between the diaphragm and the support. In a preferred implementation the connector piece has a lower modulus than the diaphragm and the support and it is made out of a rubber or silicone. Other materials can be used as well. The relative softness and compressibility of the connector material will allow for a bending of the diaphragm around a larger radius and a reduction of maximum stresses. A soft and compressible connector piece can be combined with a tapered design. A preferred implementation is shown in FIG. 4-7 where the relatively soft connector pieces are indicated with the numbers 110 and 111.

(i) Auxiliary Supports

In a three sided frameless transducer design such as those shown in FIGS. 1 to 9 the bending of the diaphragm upon impact with a hard object such as in drop on a surface from 120 cm causes high stresses at the connection points. In certain embodiments, the transducers of the invention include one or more auxiliary supports. The auxiliary support provides extra strength to the diaphragm and extra protection if the transducer is bumped or dropped.

Figure 34:
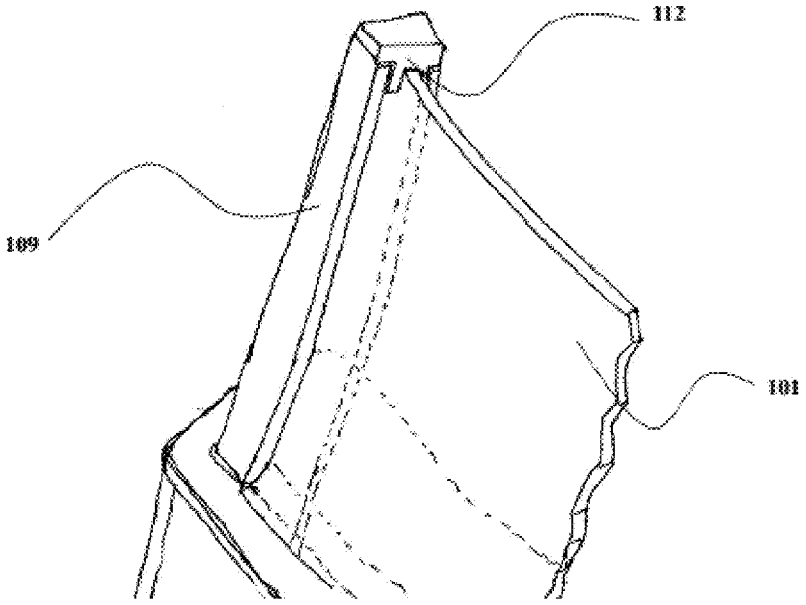
FIG. 34 is a schematic showing an auxiliary support coupled to a diaphragm via a coupling piece

In certain embodiments, the diaphragm will be coupled to two supports along each side only at its top left and top right corners even though the supports run the length of the diaphragm. The function of these supports is to prevent bending of the diaphragm to occur while still permitting the sideways movement of the diaphragm that is required as part of its function as a transducer. This can be achieved by using a coupling piece between the auxiliary support and the diaphragm that allows for some movement in plane yet prevents significant bending out of plane. An exemplary coupling piece 112 is shown in FIG. 34. The coupling piece may be constructed of any flexible material including plastic, rubber, or metal. The coupling piece can be configured so that it will flex enough to allow degrees of diaphragm movement associated with normal operation of the transducer but will limit extreme movement of the diaphragm which might damage the actuator, diaphragm, or other components of the transducer.

The auxiliary supports can be coupled to the base or support of the transducer to provide strength. The auxiliary supports can be constructed of any suitable material. In various embodiments, suitable materials for the auxiliary supports include plastic, glass, metal, carbon-fiber composite, rubber, wood, or any combination thereof. The auxiliary supports may be coupled to the diaphragm, the transducer base, or both by any mechanism known in the art, e.g., adhesives, friction, clamp, fasteners, rivets, material connection such as those made by laser welding or ultrasonic welding, or magnetic connection.

The auxiliary support can be of any height and attach to the diaphragm at one or more points along its vertical edges. Furthermore, the auxiliary support can have any cross sectional shape, including square, rectangular, circular, elliptical, or triangular.

Figure 16:
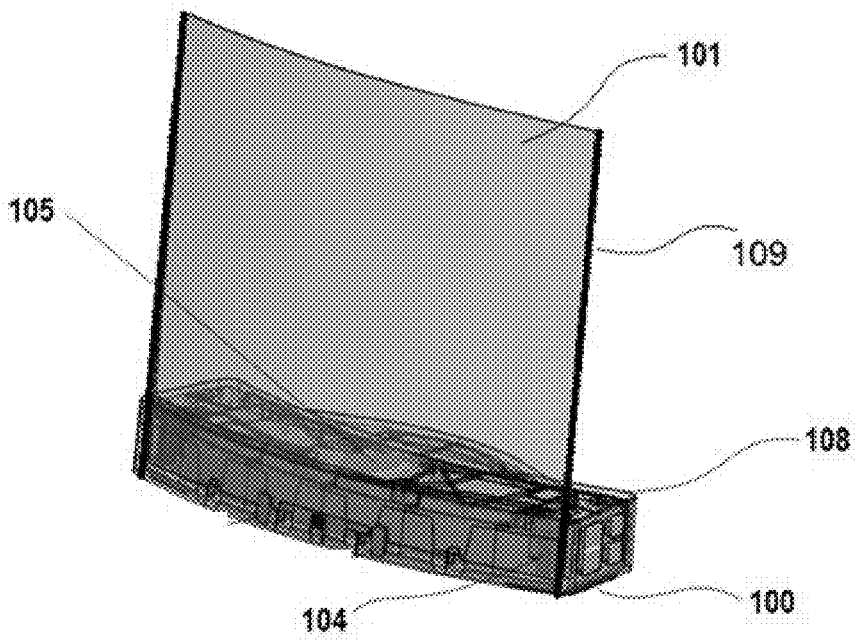
FIG. 16 is a schematic showing a transducer of the invention in which the diaphragm is coupled to two auxiliary supports.
Figure 17:
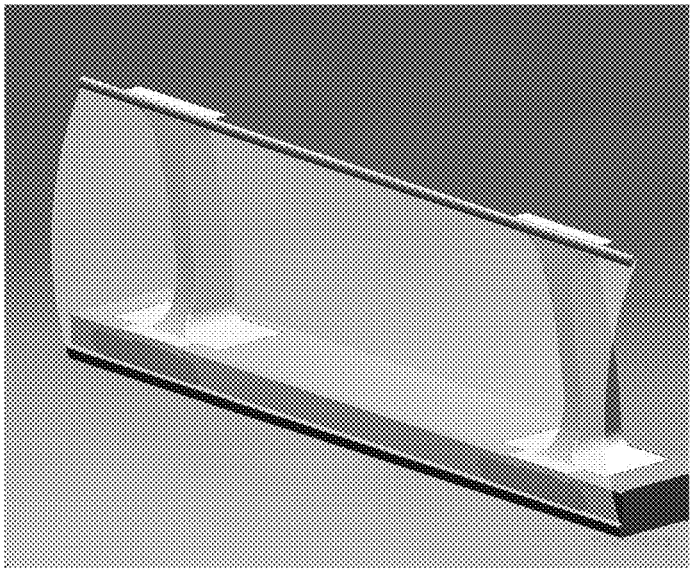
FIG. 17 is a schematic showing a front perspective view of a soundbar of the invention.

FIG. 16 shows an exemplary embodiment of a transducer of the invention having auxiliary supports 109 of equal height to the diaphragm attached to the left and right sides of the diaphragm. Auxiliary supports 109 are coupled to the support 100. This embodiment is only exemplary and not limiting in any manner of the use of the auxiliary supports. Numerous other configurations regarding the location of the supports, the number of the supports, and the coupling of the supports to the diaphragm are within the scope of the invention.

Auxiliary supports in accordance with the invention can be made in a variety of ways including but not limited to, casting, extrusion, and various types of molding. The actual method may vary depending on the configuration and material of the support. In an exemplary embodiment, extrusion is used to produce the auxiliary supports.

Extrusion is a process used to create objects of a fixed, cross-sectional profile in which the material used to create the object is pushed or drawn through a die of the desired cross-section. Extrusion is suitable for producing objects with very complex cross-sections. Extrusion may be continuous (producing indefinitely long material) or semi-continuous (producing many pieces). The extrusion process can also be performed using hot or cold starting materials. Extruded materials suitable for preparing auxiliary supports of the invention include, without limitation, metals, polymers, ceramics, and combinations thereof.

In the basic hot extrusion process, the starting material is heated and loaded into the container in the press. In cold extrusion, the starting material is kept at room temperature or near room temperature. In either case, a dummy block is placed behind the loaded container where the ram then presses on the material to push it out of the die. Afterward the extrusion is stretched in order to straighten it. If better properties are required then it may be heat treated or cold worked.

In certain aspects, the auxiliary support is a single contiguous or monolithic unit of the starting material. In other aspects, the auxiliary support may consist of multiple components such as a vertical component and a horizontal attachment component running from the vertical component to the diaphragm. As noted above, extrusion can also be used to produce members comprising multiple components. In this case, dies are prepared for each of the separate components. The starting material is again pushed through the various dies, resulting in the production of multiple components which are then connected. Any means can be used to connect the components, including welding, the use of adhesives, interlocking components, etc.

Plastic injection molding is another process which may be used to make an auxiliary support in accordance with the invention will now be provided. Plastic injection molding is well known in the art. To mass produce the auxiliary support, a mold block with the shape of the auxiliary support provided as a hollow cavity coupled to a reservoir that can inject molten plastic resin is made. The mold is made in two halves such that a completed part can be removed from one of the halves without any portion being impeded by portions of the mold cavity. Persons skilled in the art are readily familiar with the requirements. The mold is placed in a processing machine capable of clamping the two halves of the mold together with many tons of force. Molten plastic resin is injected into the cavity at very high pressure in order to facilitate rapidly filling thin or distant volumes of the mold. The need for rapid filling is due to the limited time before the molten plastic cools into a solid. Within a cycle time generally less than two minutes the mold may be closed, filled and emptied of completed parts. In order to optimize the cost and throughput of molded parts in the machine the mold may be comprised of several identical cavities. Molds can have 1, 2 or even dozens of cavities and produce a commensurate number of parts in each cycle.

Soundbar

The invention also encompasses soundbars, as shown in FIGS. 17-28. The soundbars of the invention operate in the same manner as the transducers described above. That is, a mechanical piezoelectric actuator is coupled to a diaphragm, and movement of the actuator causes movement of the diaphragm in a direction that is transverse to the movement of the actuator. The movement of the diaphragm is amplified relative to the movement of the actuator. As above, the diaphragm may be a curved diaphragm. As shown in FIGS. 17-21, diaphragm is coupled along its top portion to a support and along its bottom portion to two piezoelectric actuators. Those figures are exemplary and other configurations are within the scope of the invention. Additionally, the invention encompasses using more than two actuators.

FIGS. 17-21 show that the support is coupled to two struts. A bottom portion of each strut houses a piezo actuator. The relationship of the actuator to the strut and how the actuator fits within the struts is shown in FIGS. 22-28.

Similar to the transducers described above, soundbars of the invention may optionally include additional features so that the transducers of the invention can better withstand the environment in which they will be used without breaking. Exemplary features that can protect transducers of the invention include: (a) mechanical stop or stops to limit the maximum bending of the actuator; (b) connector piece or pieces with tapered edges; (c) actuator substrate with tapered edges; (d) diaphragm with integrated connector piece with tapered edges; (e) removable and re-attachable diaphragm; (f) mechanical stop to limit bending of diaphragm; (g) member to prevent edge impact onto diaphragm, (h) a connector piece between support and diaphragm; and (i) auxiliary supports on the left and right sides. The preferred implementation for each of these measures is described above. The measures can be used individually or in conjunction to improve the reliability of a mechanically amplified acoustic transducers with piezoelectric actuators.

Similar to above, the soundbars of the invention do not need to include all of the features. For example, soundbars of the invention can be provided with none of the additional features, with one of the additional features, or with all of the additional features. Stated another way, the additional features described herein are optional, and no embodiment of the invention should be interpreted to require any of the additional features. Also, any combination of the features may be used with soundbars of the invention.

Equivalents

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. An acoustic transducer comprising:

a curved diaphragm including a top portion, a left edge, a right edge, and a bottom portion wherein the top portion comprises a free edge, wherein the diaphragm is curved along the top and bottom portions and substantially straight on the left and right edges;

a support coupled to the diaphragm at the bottom portion;

a first auxiliary support associated with the diaphragm along the left edge;

a second auxiliary support associated with the diaphragm along the right edge; and an actuator coupled to the bottom portion of the diaphragm, wherein the acoustic transducer is configured such that the actuator, and not the first and second auxiliary supports, causes movement of the diaphragm.

2. The transducer according to claim 1, wherein the diaphragm is coupled substantially perpendicularly to the support.

3. The transducer according to claim 2, wherein the support comprises a curve that corresponds to the curve of the diaphragm.

4. The transducer according to claim 1, wherein the transducer comprises more than one free edge.

5. The transducer according to claim 1, wherein the diaphragm is composed of a material selected from the group consisting of plastic, metal, paper, carbon-fiber composite, fabric, foam, paper, glass, thin display materials and a combination thereof.

6. The transducer according to claim 1, wherein the actuator is a piezoelectric actuator.

7. The transducer according to claim 6, wherein the piezoelectric actuator is a bending-type piezoelectric actuator.

8. The transducer according to claim 7, wherein the bending-type actuator is a unimorph, bimorph, or multimorph actuator.

9. The transducer of claim 1, wherein the transducer employs mechanical amplification.

10. The transducer of claim 1, wherein movements between the actuator and the diaphragm employ mechanical amplification.

11. The transducer of claim 10, wherein a plurality of actuators act upon the diaphragm such that a plurality of audio signals is emitted separately from the diaphragm.

12. The transducer of claim 11, wherein the plurality of audio signals include a right and a left stereo signal.

13. The transducer of claim 11, wherein the plurality of audio signals includes a right, a left, and a center channel.

14. The transducer of claim 10 wherein:

a first actuator is operably coupled to a face of the curved diaphragm, near one end of the face;

a second actuator is operably coupled to the same face of the curved diaphragm, near an opposite end of the face;

and the first and second actuators are configured to move simultaneously in opposite directions so that the diaphragm oscillates between a greater and a lesser degree of curvature around a resting degree of curvature.

15. The transducer according to claim 1, wherein the diaphragm is composed of a non-piezo electric material.

16. An acoustic transducer comprising:

a curved diaphragm having a curved top portion, a curved bottom portion, a substantially straight left edge, and a substantially straight right edge;

a base coupled to the diaphragm at the curved bottom portion;

a plurality of auxiliary supports associated with the diaphragm along the left edge and along the right edge, respectively; and an actuator coupled to the diaphragm, at the curved bottom portion, wherein the acoustic transducer is configured such that the actuator, and not the first and second auxiliary supports, causes movement of the diaphragm.

17. The transducer according to claim 16, wherein the diaphragm comprises a free edge that is along the curved top portion of the diaphragm.

18. The transducer according to claim 16, wherein the diaphragm is coupled substantially perpendicularly to the base.

19. The transducer according to claim 16, wherein the diaphragm is composed of a material selected from the group consisting of plastic, metal, paper, carbon-fiber composite, fabric, foam, paper, glass or flexible display materials and a combination thereof.

20. The transducer according to claim 16, wherein the piezoelectric actuator is a bending-type piezoelectric actuator.

21. The transducer according to claim 20, wherein the bending-type actuator is a unimorph, bimorph, or multimorph actuator.

22. The transducer of claim 16, wherein the transducer employs mechanical amplification.

23. The transducer of claim 16, wherein movements between the actuator and the diaphragm employ mechanical amplification.

24. The transducer of claim 23, wherein a plurality of actuators act upon the diaphragm such that a plurality of audio signals is emitted separately from the diaphragm.

25. The transducer of claim 24, wherein the plurality of audio signals include a right and a left stereo signal.

26. The transducer of claim 24, wherein the plurality of audio signals includes a right, a left, and a center channel.

27. The transducer of claim 23 wherein:

a first actuator is operably coupled to a face of the curved diaphragm, near one end of the face;

a second actuator is operably coupled to the same face of the curved diaphragm, near an opposite end of the face; and the first and second actuators are configured to move simultaneously in opposite directions so that the diaphragm oscillates between a greater and a lesser degree of curvature around a resting degree of curvature.

28. The transducer according to claim 16, wherein the diaphragm is composed of a non-piezo electric material.

* * * * *